US011829086B2

(12) United States Patent
Takahashi

(10) Patent No.: US 11,829,086 B2
(45) Date of Patent: *Nov. 28, 2023

(54) DEVELOPING APPARATUS

(71) Applicant: CANON KABUSHIKI KAISHA, Tokyo (JP)

(72) Inventor: Kyosuke Takahashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/582,034

(22) Filed: Jan. 24, 2022

(65) Prior Publication Data

US 2022/0146963 A1 May 12, 2022

Related U.S. Application Data

(60) Division of application No. 16/893,558, filed on Jun. 5, 2020, now Pat. No. 11,256,195, which is a division (Continued)

(30) Foreign Application Priority Data

May 22, 2014 (JP) ..... 2014-106209

(51) Int. Cl.
*G03G 15/09* (2006.01)
*G03G 15/08* (2006.01)

(52) U.S. Cl.
CPC ..... *G03G 15/0928* (2013.01); *G03G 15/08* (2013.01); *G03G 15/0812* (2013.01); *G03G 15/09* (2013.01); *G03G 15/0921* (2013.01)

(58) Field of Classification Search
CPC ..... G03G 15/0921; G03G 15/0928; G03G 15/0812
See application file for complete search history.

(56) References Cited

U.S. PATENT DOCUMENTS 5,158,852 A 10/1992 Sakata et al.
7,536,141 B2 5/2009 Miyoshi
(Continued)

FOREIGN PATENT DOCUMENTS

CN 101295158 A 10/2008
JP H03-163569 A 7/1991
(Continued)

OTHER PUBLICATIONS

PCT International Search Report and the Written Opinion dated Jul. 7, 2015, in PCT/JP2015/065327.
(Continued)

*Primary Examiner* — Erika J. Villaluna
(74) *Attorney, Agent, or Firm* — VENABLE LLP

(57) ABSTRACT

A change of a magnetic flux density distribution adjacent to a regulating blade 9 opposed to a developer regulation pole is suppressed at a low cost, while suppressing influence to design latitude of magnetic poles. A position on the outer peripheral surface of the developing sleeve where the magnetic flux density in the normal line direction of the outer peripheral surface of the developing sleeve is a maximum value position. The position on the outer peripheral surface of the developing sleeve 8 corresponding to a center portion position of the half peak range of the magnetic flux density distribution of the developer regulation pole is called half peak center portion. The developer regulation pole is formed such that the maximum value position is deviated not less than 3° in the circumferential direction of the developing sleeve from the half peak center portion position, and the position when the regulating blade 9 opposite is the developing sleeve is in a side of the maximum value position in which the half peak center portion position exists.

11 Claims, 10 Drawing Sheets

Related U.S. Application Data of application No. 16/379,995, filed on Apr. 10, 2019, now Pat. No. 10,705,451, which is a division of application No. 15/348,147, filed on Nov. 10, 2016, now Pat. No. 10,303,084, which is a continuation of application No. PCT/JP2015/065327, filed on May 21, 2015.

(56) References Cited

U.S. PATENT DOCUMENTS

| | | | |
|---|---|---|---|
| 7,769,326 | B2 | 8/2010 | Miyoshi |
| 3,014,705 | A1 | 9/2011 | Matsumoto et al. |
| 9,304,446 | B2 | 4/2016 | Akita et al. |
| 2008/0145107 | A1 | 6/2008 | Miyoshi |

FOREIGN PATENT DOCUMENTS

| | | | |
|---|---|---|---|
| JP | 2002-244440 | A | 8/2002 |
| JP | 2002-278281 | A | 9/2002 |
| JP | 2003-140463 | A | 5/2003 |
| JP | 2004-219510 | A | 8/2004 |
| JP | 2006-011030 | A | 1/2006 |
| JP | 2006-292980 | A | 10/2006 |
| JP | 2008-145968 | A | 6/2008 |
| JP | 2009-175674 | A | 8/2009 |
| JP | 2011-164323 | A | 8/2011 |
| JP | 2012-053154 | A | 3/2012 |
| JP | 2013-231853 | A | 11/2013 |
| WO | 2013/162074 | A1 | 10/2013 |

OTHER PUBLICATIONS

European Search Report dated Dec. 22, 2017, in related European Patent Application No. 15795755.6.

Japanese Office Action dated Jan. 30, 2018, in related Japanese Patent Application No. 2014-106209.

European Search Report dated Jul. 17, 2018, in related European Patent Application No. 15 795 755.6.

Tamura et al., JP Computer Translation of JP 2003-140464.

Chinese Office Action dated Mar. 21, 2019, in related Chinese Patent Application No. 201580026428.6 (with English translation).

European Search Report dated Aug. 2, 2019, in related European Patent Application No. 19156376.6.

European Office Action dated Jun. 25, 2019, in related European Patent Application No. 15795755.6.

Japanese Office Action dated Jun. 30, 2020, in related Japanese Patent Application No. 2019-104140.

European Office Action dated Jun. 23, 2021, in related European Patent Application No. 19 156 376.6.

Japanese Office Action dated Jun. 29, 2021, in related Japanese Patent Application No. 2020-140905.

DEVELOPING APPARATUS

This application is a divisional of application Ser. No. 16/893,558, filed Jun. 5, 2020, which is a divisional of application Ser. No. 16/379,995, filed Apr. 10, 2019, now U.S. Pat. No. 10,705,451, issued Jul. 7, 2020, which is a divisional of application Ser. No. 15/348,147, filed Nov. 10, 2016, now U.S. Pat. No. 10,303,084, issued May 28, 2019, which is a continuation of PCT Application No. PCT/JP2015/065327, filed May 21, 2015.

FIELD OF THE INVENTION

The present invention relates to a developing apparatus or device for developing an electrostatic latent image formed on an image bearing member such as a photosensitive drum, using a developer containing toner and carrier.

BACKGROUND ART

In an image forming apparatus using an electrophotographic type or electrostatic recording type process such as a copying machine, a printer, a facsimile machine or a multifunction machine having a plurality of functions of them, the developer is deposited on the electrostatic latent image formed on the image bearing member such as the photosensitive drum to visualize (develop) the electrostatic latent image. A developing device for such development using a two component developer (developer) of a toner, which is non-magnetic particles, and a carrier which is magnetic particles, is known.

In such a developing device, the developer is carried on a surface of a developing sleeve which encloses a magnet, and by rotating the developing sleeve, the developer is fed. An amount of the developer (layer thickness) on the developing sleeve is regulated by a regulating blade as a developer regulating member disposed in proximity with the developing sleeve, and then the developer is fed to a developing zone opposed to the photosensitive drum. Then, the electrostatic latent image formed on the photosensitive drum is developed by the toner in developer.

With such a structure, the amount of the developer fed to the regulating blade may change if the positional relationship between a distribution of a magnetic flux density of the magnet and the regulating blade deviates. Therefore, a proposal has been made in which a magnetic pole disposed opposed to the regulating blade has a substantially symmetrical magnetic flux density, and the position of the regulating blade is displaced from a peak position of the magnetic flux density distribution of the magnetic pole within a half-peak width of the magnetic flux density (Japanese Laid-open Patent Application 2003-140463).

Japanese Laid-open Patent Application 2013-231853 discloses a structure including a guiding member provided upstream of the regulating blade with respect to a rotational moving direction of the developing sleeve to guide the developer toward the developing sleeve.

SUMMARY OF THE INVENTION

Problem to be Solved

The magnet involves a predetermined tolerance relative to a design reference position. For example, the position of the magnetic flux density peak of the magnetic pole opposed to the regulating blade may deviate from the design reference position within a tolerance range. With such a deviation of the position of the magnetic flux density peak, the magnetic flux density distribution adjacent to the regulating blade changes with the result that the developer feeding amount changes and the regulation of the developer by the regulating blade is not stabilized.

With the structure of Japanese Laid-open Patent Application 2003-140463 in which the magnetic flux density distribution is substantially symmetrical, it would be considered that the half-peak width is expanded to the change within the tolerance. More particularly, by expanding the half-peak width, the change in the magnetic flux density distribution adjacent to the regulating blade is suppressed to stabilize the feeding amount of the developer.

However, if the half-peak width of the magnetic flux density distribution is expanded, the width of the magnetic pole increases. Since the magnet has a plurality of magnetic poles arranged in a circumferential direction, the increase of the width of one magnetic pole decreases latitude in the designing of the other magnetic poles. For example, with respect to the diametrical direction of the magnet, there is a limit in terms of the regulating blade, and therefore, the width of another magnetic pole in the circumferential direction is limited.

Therefore, it would be considered that the tolerance of the magnet is decreased in an attempt to stabilize the developer feeding amount, but then, the manufacturing cost rises. Such a problem is involved in the structure disclosed in Japanese Laid-open Patent Application 2013-231853.

Under the circumstance, the present invention is made to accomplish a structure with which the change of the magnetic flux density distribution, adjacent to the developer regulating member, of the developer regulation pole opposed to the developer regulating member can be suppressed at low cost, while suppressing influence to the design latitude of another magnetic pole.

Means for Solving Problem

According to an aspect of the present invention, there is provided a developing apparatus comprising a developing container configured to accommodate a developer containing toner and carrier; a developing sleeve rotatably supported by the developing container and configured to carry the developer from said developing container; and a magnet provided in said developing sleeve and having a plurality of magnetic poles arranged in a circumferential direction; a regulating member provided opposed to said developing sleeve with a predetermined gap therebetween and configured to regulate a layer thickness of the developer carried on said developing sleeve, wherein said magnetic poles include a regulation pole disposed opposed to said regulating member, and said regulation pole is disposed such that a maximum value position at which a magnetic flux density in a normal line direction of said developing sleeve is a maximum is not less than 3° away in a circumferential direction of said developing sleeve from a half peak center portion position which is a center portion position of a half-peak width of the magnetic flux density, and wherein said regulating member is disposed in a side of the maximum value position including the center portion position with respect to the circumferential direction of said developing sleeve.

With the present invention, the maximum value position is away from the center portion position of the half peak range by not less than 3°, and the regulating member is in a side of the maximum value position in which the center portion position of the half peak range exists. Therefore, the change of the magnetic flux density distribution adjacent to the regulating member can be suppressed at low cost, while suppressing the influence to the design latitude of another magnetic pole.

DESCRIPTION OF THE EMBODIMENTS

First Embodiment

Figure 1:
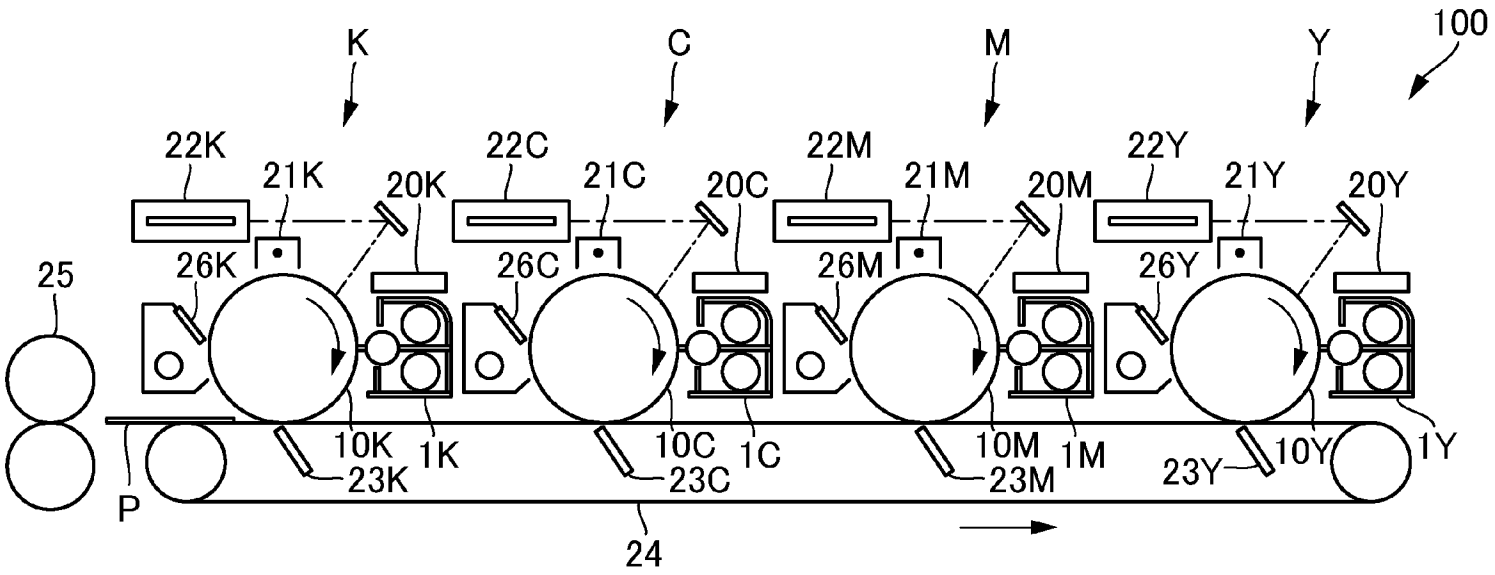
FIG. 1 is a schematic illustration of an image forming apparatus according to a first embodiment of the present invention.

Referring to FIG. 1 to FIG. 7, a first embodiment of the present invention will be described. Referring to FIG. 1 first, a schematic structure of an image forming apparatus including a developing device according to this embodiment will be described.

[Image Forming Apparatus]

The image forming apparatus 100 is an electrophotographic type full color printer including four image forming stations Y, M, C, K corresponding to yellow, magenta, cyan and black colors, respectively. The image forming apparatus 100 forms a toner image (image) on a recording material P in accordance with an image signal supplied from a host equipment such as an original reading apparatus (unshown) connected with a main assembly of the image forming apparatus or a personal computer or the like communicatably connected with the main assembly of the image forming apparatus. The recording material may be a sheet material such as a sheet of paper, a plastic resin film, textile or the like. In an image forming process, the image forming stations Y, M, C, K form color toner images on photosensitive drums (electrophotographic photosensitive members) 10Y, 10M, 10C, 10K as image bearing members, respectively. The toner images thus formed are transferred onto the recording material P. The recording material having the transferred toner image is conveyed into a fixing device 25, when the toner image is fixed on the recording material. Detailed description will be made.

The four image forming stations Y, M, C, K of the image forming apparatus 100 are substantially the same in the structure except for the developing colors being different from each other. Therefore, in the following description, the suffixes Y, M, C, K indicating the respective image forming stations are omitted, unless otherwise required.

The image forming station includes a photosensitive drum 10 which is cylindrical, as the image bearing member. The photosensitive drum 10 is rotated in the direction indicated by an arrow in the Figure. Around the photosensitive drum 10, there are provided a charger 21 as charging means, a developing device 1 as developing means, a primary transfer charger 23 as transferring means and a cleaning device 26 as cleaning means. Above the photosensitive drum 10 in the Figure, there is provided a laser scanner (exposure device) 22 as exposure means.

In addition, a recording material feeding belt 24 is provided opposed to the photosensitive drums 10 of the image forming stations. The recording material feeding belt 24 is stretched by a plurality of rollers and rotates circumferentially in the direction indicated by an arrow in the Figure. A fixing device 25 is provided downstream of the recording material feeding belt 24 with respect to the feeding direction of the recording material.

The process of the formation of a four(full)-color by the image forming apparatus 100 having the above-described structure will be described. When the image forming operation is started, a surface of the rotating photosensitive drum 10 is uniformly charged by the charger 21. Then, the photosensitive drum 10 is exposed to a laser beam modulated in accordance with the image signal produced by an exposure device 22. By this, an electrostatic latent image is formed on the photosensitive drum 10 in accordance with the image signal. The electrostatic latent image on photosensitive drum 10 is visualized with the toner accommodated in the developing device 1 into a visualized image. The toner in the developer consumed with the image forming operation is supplied from a hopper 20 as a toner supply container.

The toner image thus formed on the photosensitive drum 10 is transferred onto a recording material P fed by the recording material feeding belt 24, in a transfer portion constituted between the recording material feeding belt 24 and a primary transfer charger 23 provided opposed to the recording material feeding belt 24. The toner (untransferred toner) remaining on the photosensitive drum 10 after the image transfer is removed by the cleaning device 26.

Such operations are carried out sequentially in the yellow, magenta, cyan and black image forming stations, so that the four color toner images are superposed on the recording material P fed by the recording material feeding belt 24. Then, the recording material P is conveyed into the fixing device 25 as fixing means. The toner on the recording material P is melted, mixed and fixed on the recording material P into a full-color image by being heated and pressed by the fixing device 25. Thereafter, the recording material P is discharged to an outside of the apparatus. By this, a series of image forming process operations is completed. A monochromatic or multi-color image can be formed using a desired image forming station or image forming stations only.

[Developing Device]

Referring to FIG. 2 to FIG. 5, the structure of the developing device 1 will be described in detail. The developing device 1 includes a developing container 2 accommodating the developer containing the toner and carrier, a developing sleeve 8 as a developer carrying member rotatable to carry the developer from the developing container. In the developing container 2, there is provided feeding screws 5, 6 as the developer feeding members for circulating the developer in the developing container while stirring and feeding the developer. In the developing sleeve 8 a non-rotatable magnet 8*a* having a plurality of magnetic poles arranged in a circumferential direction is provided.

The developer is a two component developer including non-magnetic toner and magnetic carrier. The toner comprises base material including coloring material and binder resin, and an additive added to the base material. The resin material of the toner is negative charging property polyester resin material in this embodiment. A volume average particle size thereof is preferably not less than 4 μm and not more than 10 μm, and is 7 μm in this embodiment. If the particle size of the toner is too small, the friction between the toner and the carrier is difficult with the result of difficulty of the control of the charge amount, and if it is too large, precise toner image cannot be formed.

The carrier may be made of metal such as surface-oxidized or non-surface-oxidized iron, nickel, cobalt, manganese, chromium, rare earth or the like, or oxide ferrite or the like, and in this embodiment, it is ferrite carrier having an average volume particle size of 50 μm. If the particle size of the carrier is too small, the carrier is deposited on the latent image bearing member in the development, and if it is too large, the toner image is disturbed by the carrier in the development. In this embodiment, the developing container accommodates the 300 g of the developer, and the developer contains the toner and the carrier at a weight ratio of 1:9 at the time of installation of the apparatus.

Such a developer is carried on the surface of the developing sleeve 8 by a magnetic force of the magnet 8*a* in the developing sleeve 8, and the developer is fed in a feeding direction b by the rotation of the developing sleeve 8. Then, the developer is supplied onto the electrostatic latent image formed on the photosensitive drum 10. The feeding screws 5, 6 are each provided with a helical screw blade on a rotation shaft and feed the developer in the axial direction by the rotation thereof.

Figure 2:
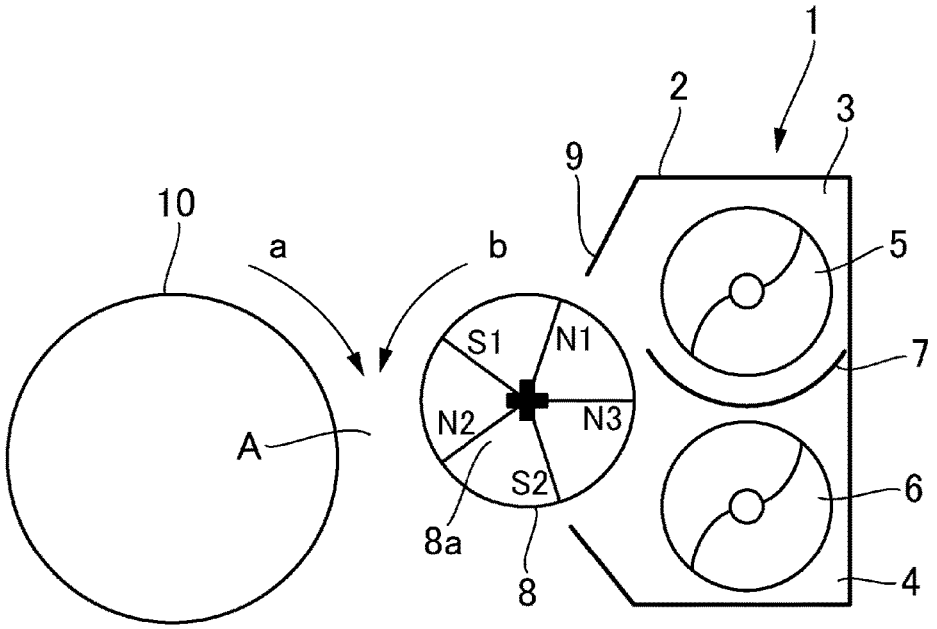
FIG. 2 is a schematic sectional view of a developing device according to the first embodiment, as viewed from a front side of FIG. 1.
Figure 3:
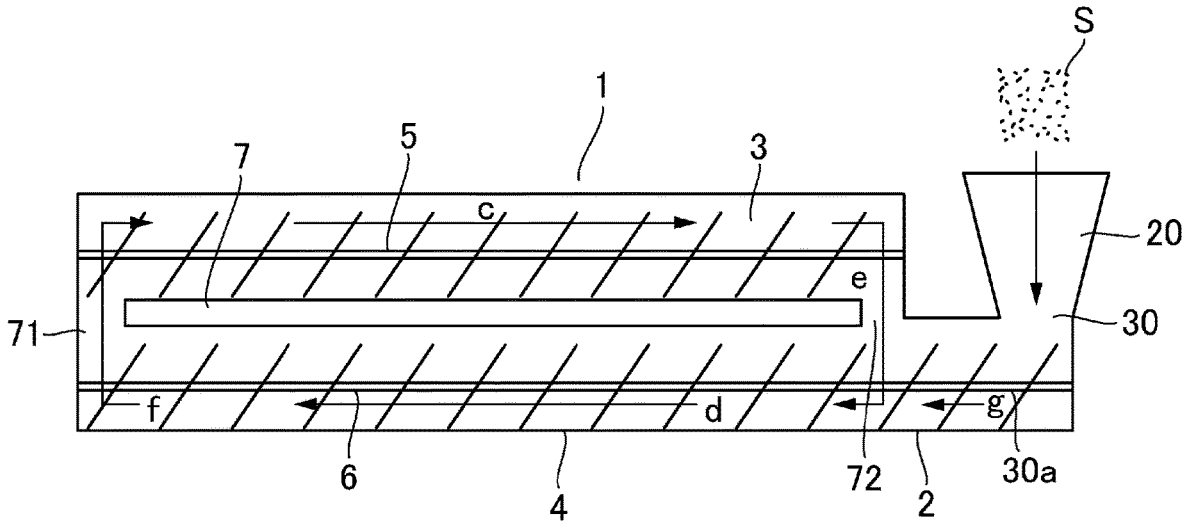
FIG. 3 is a longitudinal schematic sectional view of the developing device according to the first embodiment.

Referring to FIGS. 2 and 3, the description will be made in more detail. The inside of the developing container 2 is partitioned into a developing chamber 3 and a stirring chamber 4 by a partition 7 extending in a direction perpendicular to the sheet of the drawing substantially at a central portion, the developing chamber 3 and the stirring chamber 4 being arranged substantially vertically, and the developer is accommodated in the developing chamber 3 and the stirring chamber 4.

The developing chamber 3 and the stirring chamber 4 are provided with the feeding screws 5, 6, respectively. The feeding screw 5 extends along the axial direction of the developing sleeve 8 at the bottom portion of the developing chamber 3 and driven by a motor (unshown) to feed the developer in a direction of an axial direction c in the developing chamber 3 and to feed the developer to the developing sleeve 8. The feeding screw 6 extends along the axial direction of the developing sleeve 8 at the bottom portion of the stirring chamber 4 to feed the developer in the direction opposite to the feeding direction of the feeding screw 5 in the stirring chamber 4. In this embodiment, the rotation shaft is rotated at 900 rpm to circulate the developer.

The developing chamber 3 and the stirring chamber 4 are in fluid communication with each other through communicating portions 71 and 72. In the communicating portion 71, the developer collected from the developing sleeve 8 in the stirring chamber 4 and the developer fed into the developing chamber 3 are lifted into the developing chamber 3. In the communicating portion 72, the developer passed through the developing chamber 3 without being supplied from the developing chamber 3 to the developing sleeve 8 is fed into the stirring chamber 4. In this manner, by the feeding by the rotation of the feeding screws 5 and 6, the developer is circulated between the developing chamber 3 and the stirring chamber 4 through the communicating portions 71 and 72 provided at the opposite end portions of the partition 7. There are two paths for the stirring and feeding of the developer. A first path is from the developing chamber 3 back to the developing chamber 3 by way of the developing sleeve 8, the stirring chamber 4 and the communicating portion 71 (the path contributing to the development). A second path is from the developing chamber 3 back to the developing chamber 3 through the communicating portion 72, the stirring chamber 4 and, the communicating portion 71 (the path not contributing to the development).

Referring to FIG. 2, the structure for feeding the developer by the developing sleeve 8 will be described. The developing container 2 is provided with an opening at a position corresponding to a developing zone A opposed to the photosensitive drum 10, and the developing sleeve 8 is rotatably provided so that a part of the developing sleeve 8 is exposed toward the photosensitive drum 10 through the opening. On the other hand, the magnet 8*a* in the developing sleeve 8 is non-rotatable.

The description will be made as to the flow of the developer around the developing sleeve 8. First, with the developer feeding by the feeding screw 5, the developer jumps to be supplied to the developing sleeve 8. Because the developer contains the magnetic carrier, the developer is confined by the magnetic force produced by the magnet 8*a* in the developing sleeve 8, and with the rotation of the developing sleeve 8, the developer on the developing sleeve 8 passes a regulating blade 9 as a developer regulating member, by which the developer is regulated into a predetermined amount. The thus regulated developer is fed into the developing zone A opposed to the photosensitive drum 10, so that the toner is supplied to the electrostatic latent image. The developer passed through the developing zone A is collected to the second feeding screw 6 in the developing container.

[Developing Sleeve]

The developing sleeve 8 is rotated by the motor (unshown) to feed the developer to the photosensitive drum 10. In this embodiment, the developing sleeve 8 is cylindrical and is made of aluminum, and the diameter thereof is 20 mm in the cross-section at the position where it is opposed to the drum. A surface property of the developing sleeve 8 and a feeding performance for the developer will be described. In the case that the surface of the developing sleeve 8 is smooth as with a specular surface, the friction between the developer and the surface of the developing sleeve is extremely small, and therefore, the developer is hardly fed by the rotation of the developing sleeve 8. By providing the surface of the developing sleeve with proper unsmoothness, the frictional force is produced between the surface of the developing sleeve and the developer so that the developer follows the rotation of the developing sleeve. In this embodiment, the surface of the developing sleeve 8 is subjected to a blast treatment to provide the unsmoothness of surface roughness of 15μ approx.

In the blast treatment, the grinding powder and/or glass beads or the like having a predetermined particle size distribution are blasted with a high-pressure. A portion having been subjected to the blast process is called the blasted area, and an end portion not having been subjected to the blast process is called the non-blasted area. The developing sleeve moves the developer by the blasted area, and therefore, the blasted area is required to be slightly broader than an image forming region.

[Magnet]

In the developing sleeve 8, the magnet 8*a* as magnetic field generating means in the form of a roller is disposed non-rotatably. As shown in FIG. 2, the magnet 8*a* is provided with 5 magnetic poles N1, N2, N3, S1 and S2 arranged in the circumferential direction. FIG. 2 shows positions of maximum magnetic flux densities by the respective magnetic poles in the normal line direction relative to the outer peripheral surface of the developing sleeve 8. At the position opposing to the developing zone A, a developing magnetic pole N2 is disposed to form a magnetic brush of the developer by the magnetic field of the N2 pole formed in the developing zone A. The magnetic brush contacts the photosensitive drum 10 rotating in the direction indicated by an arrow a, and the charged toner develops the electrostatic latent image by an electrostatic force into a toner image, in the developing zone A.

The description will be made as to the functions of the respective magnetic poles of the magnet 8*a* as to the flow of the developer. By the developer feeding operation of the feeding screw 5, the developer jumps to be supplied to the developing sleeve 8, and then, the developer is confined by the magnetic force provided by the N1 pole (developer regulation pole) because the developer contains magnetic carrier. Subsequently, with the rotation of the developing sleeve 8, the developer passes the position opposing to the regulating blade 9, by which the amount of the developer is regulated to a predetermined amount. The thus regulated developer passes the S1 pole to be supplied to the N2 pole opposing to the photosensitive drum 10. The developer which has passed through the developing zone A and from which the toner is concerned for the electrostatic latent image is taken into the developing container by the S2 pole, and is released from a magnetic confining force between the N3 pole and the N1 pole, so that the developer is collected by the feeding screw 6.

[Regulating Blade]

Here, the regulating blade 9 is opposed to the outer peripheral surface of the developing sleeve 8 with a predetermined gap therebetween to regulate a layer thickness of the developer carried on the developing sleeve 8. For this purpose, the regulating blade 9 is disposed upstream of the developing zone A with respect to the rotational moving direction of the developing sleeve 8. In this embodiment, the regulating blade 9 is a plate-like member extending along the rotational axis direction (longitudinal direction) of the developing sleeve 8. The material of the regulating blade 9 is aluminum. The regulating blade 9 is provided on the developing container the so that a free end portion of the blade is directed to the center of the sleeve in the position upstream of the photosensitive drum 10 with respect to the rotational direction of the developing sleeve 8. By the rotation of the member, the developer on the developing sleeve 8 passes between the free end portion of the regulating blade 9 and the developing sleeve 8 and fed into the developing zone A. Therefore, by adjusting the gap between the regulating blade 9 and the surface of the developing sleeve 8, the amount of the developer carried on the developing sleeve 8 into the developing zone can be adjusted.

If the gap between the regulating blade 9 and the developing sleeve 8 is too small, foreign matter in the developer powder and/or agglomeration mass of toner tends to be clogged in the gap, and therefore, such a small gap is not preferable. If the weight of the developer per unit area carried on the developing sleeve 8 is too large, the developer may clog adjacent the position opposing to the photosensitive drum 10, or the carrier may be deposited on the photosensitive drum 10, or another problem may arise. On the other hand, if the weight of the developer per unit area carried on the developing sleeve 8 is too small, a desired amount of the toner is not supplied to the latent image with the result of decrease of the image density. In this embodiment, the clearance between the regulating blade 9 and the developing sleeve 8 is 400 μm such that an amount of the carried developer regulated by the regulating blade 9 is 30 mg/cm^2.

In addition, in this embodiment, the diameter of the developing sleeve 8 is 20 mm, the diameter of the photosensitive drum 10 is 80 mm, and a gap between the developing sleeve 8 and the photosensitive drum 10 in the closest region is 400 μm. With this structure, the development is carried out while the developer fed into the developing zone A is in contact with the photosensitive drum 10.

In the above-described structure, the developing sleeve 8 is rotated in a direction indicated by an arrow b in the development as shown in FIG. 2, and the developer properly regulated by the regulating blade 9 is fed into the developing zone A opposed to the photosensitive drum 10. In the mail, the developer is formed into a magnetic brush by the magnetic fields provided by the magnet 8*a* than that of supply the toner to the electrostatic latent image formed on the photosensitive drum 10 to provide a toner image. At this time, the developing sleeve 8 is supplied with a developing bias voltage in the form of a DC voltage biased by an AC voltage from the voltage source (unshown). In this embodiment, the developing bias voltage comprises DC voltage of −500V and the AC voltage which is in the form of a rectangular wave and which has a peak-to-peak voltage Vpp of 1800V and a frequency f of 12 kHz. However, the DC voltage value and the AC voltage waveform are not limited to these examples. In the member, a non-image region on the photosensitive drum 10 is charged to −600V, and in an image region of the electrostatic latent image, the potential is made high in accordance with a density of the output image by the laser beam.

In the developing zone A, the peripheral surface of the developing sleeve 8 moves codirectionally with the peripheral surface movement of the photosensitive drum 10, and a peripheral speed of the photosensitive drum 10 is 300 mm/s, and a peripheral speed of the developing sleeve 8 is 450 mm/s. The peripheral speed ratio between the developing sleeve 8 and the photosensitive drum 10 is ordinarily 1-2—times. With the increase of the peripheral speed ratio, the toner supply amount increases, but if it is too large, the problem of toner scattering or the like arises. The toner consumption amount for the maximum density is 0.5 mg/cm^2, and the maximum consumption for an A4 size sheet is 0.31 g.

[Supply of Developer]

Referring to FIG. 3, the supply of the developer into the developing container 2 will be described. In this embodiment, an amount of the developer substantially equivalent to the consumed developer is supplied from the hopper 20 (FIG. 1) as a supply material. FIG. 3 is a longitudinal sectional view of the developing container illustrating the developer circulation path. However, the hopper 20 is connected with the developing container 2 for better illustration of the path of the supply material S. Above the developing device 1, the hopper 20 for accommodating the supply material S is disposed. The hopper 20 constituting supplying means is connected with a supply opening 30 of the developing device.

The amount of the toner equivalent to the toner consumed by the image formation is supplied into the developing container 2 through the supply opening 30 from the hopper 20. The supply material is fed from the supply opening 30 in a direction indicated by an arrow g by the supplying screw 30*a* to the developer circulation path. The supply opening 30 is disposed downstream of the developing chamber 3. By this, it is avoided that the supply material introduced to the circulation path is supplied to the developing sleeve 8 before being stirred. Adjacent to the communicating portion 71 of the developing device 1, a toner density sensor (unshown) is provided to detect a magnetic permeability of the developer for a predetermined volume adjacent to the surface of the sensor and calculate a ratio of the toner and the carrier, and the supply amount is adjusted so that the toner content (weight ratio) is approx. 10%.

With the image forming operation, the toner in the developing container is subjected to a load, by which a shape and/or a surface property thereof changes with the result of change in the toner property. Such a change of the toner property is dependent on the time duration in which the toner is subjected to the load in the developing device, and therefore, is remarkable when the image forming operation is repeated for images requiring small amounts of toner consumption. In the case of a color image forming apparatus comprising a plurality of developing devices, some developing devices may not consume the toner. Ordinarily, in order to maintain the toner property within a predetermined range, a minimum toner consumption amount for a predetermined number of sheets or a cumulative number of rotations of the developing sleeve is predetermined, and when the toner consumption is lower than the minimum toner consumption amount, a developing operation is carried out for an area outside the image forming region or is carried out during an integral between image formations to replace the toner with fresh toner. In this embodiment, the minimum toner consumption amount is predetermined as being 1% of A4 whole surface consumption (100%) for the maximum density image. In other words, when an average toner consumption amount of a predetermined number of sheets is lower than 1% of the whole surface consumption, the control for the toner consumption is carried out such that the average toner consumption amount is 1%. Therefore, the change of the toner property is the maximum at the time when the images of the toner consumption of 1% are continuously formed. However, it requires approx. 10,000 sheets of image formations for an average time during which the toner in the developing device is subjected to the load to reach a normal value (image formation with 1% of the toner consumption). These can be calculated from the toner consumption amount and the toner amount in the developer.

The feeding performance of the developer by the developing sleeve 8 will be described. The developing sleeve 8 magnetically confines the developer containing the carrier to be magnetized by a magnetic flux distribution formed by the magnet 8*a* in the developing sleeve 8, and by the rotation of the developing sleeve 8 having the unsmooth surface, the developer is conveyed by the frictional force directed to the rotational moving direction. The amount of the developer fed to the neighborhood of the photosensitive drum 10 is determined by the amount of the developer capable of passing through the gap between the developing sleeve 8 and the regulating blade 9, and therefore, a passing angle of the magnetic chain of the developer passing through the opposing portion of the regulating blade 9 is important in addition to the gap between the developing sleeve 8 and the regulating blade 9. The passing angle of the developer is determined by the magnetic flux distribution provided by the magnet in the blade opposing portion. Therefore, it is desirable that the change of the magnetic flux distribution in the neighborhood of the blade depending on the process capability of the magnet 8*a* (tolerance of the magnet per se during the manufacturing of the magnet) and/or the accuracy of the mounting of the magnet 8*a* is minimized.

[Magnetic Flux Distribution and Magnetic Force to Carrier by the Magnet]

The magnetic flux density and the magnetic force provided by the magnet 8*a* will be described. In the description, Br, Bθ, Fr, Fθ are defined as follows:

Br: the magnetic flux density in the normal line direction (perpendicular direction) relative to the outer peripheral surface (surface) of the developing sleeve 8 at a point, Bθ: the magnetic flux density in the tangential direction relative to the outer peripheral surface of the developing sleeve 8 at a point, Fr: the magnetic force in the normal line direction relative to the outer peripheral surface of the developing sleeve 8 (negative in the attracting direction, that is, toward the developing sleeve 8) at a point, Fθ: the magnetic force in the tangential direction relative to the outer peripheral surface of the developing sleeve 8 (positive in the rotational direction of the developing sleeve 8) at a point.

The magnetic flux densities and magnetic forces will be expressed simply by Br, Bθ, Fr, Fθ in the following description unless otherwise stated.

[Measuring Method for Magnetic Force and Magnetic Flux Density]

The measuring method for the magnetic force in this embodiment will be described. The magnetic force in this embodiment is calculated by the following calculating method. The magnetic force applied to the carrier can be determined by the following equation (1), where μ0 is the magnetic permeability of vacuum, μ is the magnetic permeability of the carrier, b is the radius of carrier, and B is the magnetic flux density:

$$\vec{F} = \frac{\mu - \mu_0}{\mu_0(\mu + 2\mu_0)} 2\pi b^3 \nabla B^2 \quad (1)$$

Therefore, $$\vec{F} \propto \nabla B^2 = \frac{\partial}{\partial r}(Br^2 + B\theta^2)\vec{e}_r + \frac{1}{r}\frac{\partial}{\partial\theta(B_r^2 + B_\theta^2)}\vec{e}_0 \quad (2)$$

$$\therefore \vec{F} \propto \underbrace{\left(B_r\frac{\partial B_r}{\partial r} + B_\theta\frac{\partial B_\theta}{\partial r}\right)\vec{e}_r}_{Fr} + \underbrace{\frac{1}{r}\left(B_r\frac{\partial B_r}{\partial\theta} + B_\theta\frac{\partial B_\theta}{\partial\theta}\right)\vec{e}_0}_{F\theta}$$

From the question (2), if Br and Bθ are known, then Fr and Fθ can be determined. The magnetic flux density Br is measured by magnetic field measuring device MS-9902 (tradename) available from F.W.BELL Co., while setting the distance between the surface of the developing sleeve and a probe of the measuring device at approx. 100 μm.

The magnetic flux density Bθ can be determined as follows: The vector potential AZ (R, θ) is expressed as follows using the measured magnetic flux density Br, $$A_z(R, \theta) = \int_0^\theta RBrd\theta \quad (3)$$

With the boundary condition being Az (R, θ), from the following equation, $$\nabla 2Az(R,\theta)=0$$

$Az(r,\theta)$can be obtained.

$$B_r = \frac{1}{r}\frac{\partial A_z(r, \theta)}{\partial\theta} \quad (4)$$

From $$B_\theta = -\frac{\partial A_z(r, \theta)}{\partial r} \quad (5)$$

$Br,B\theta$can be obtained.

By applying the thus obtained Br and Bθ to the question (1), Fr and Fθ can be obtained. In addition, using the question, the distribution of the magnetic flux density providing the Fr distribution, which is necessary in this embodiment, can be obtained.

[Stability of Amount of Developer Feeding]

The description will be made as to the stability of the feeding of the developer by the developing sleeve 8 using the regulating blade 9. Adjacent to the regulating blade 9, the developer receives a force in the direction opposite to the feeding direction by the developing sleeve 8. Therefore, in the case that the magnetic chains formed in the blade opposing portion where the regulating blade 9 is opposed to the developing sleeve 8 are inclined toward the upstream side beyond the normal line of the outer peripheral surface of the developing sleeve 8, the magnetic chains are easily broken by the force received adjacent to the blade opposing portion. And, the amount of the developer passing the regulating blade 9 is unstable with the result of large variation of the feeding amount.

Therefore, in order to stabilize the amount of the developer passing the regulating blade 9, it is preferable to direct the magnetic chain formed adjacent to the blade opposing portion toward the downstream side. To accomplish this, the position where the magnetic force line adjacent to the blade opposing portion extends in the normal line direction relative to the outer peripheral surface of the developing sleeve 8 is made upstream of the blade opposing portion. In other words, the position on the outer peripheral surface of the developing sleeve 8 where the magnetic flux density (Bθ) in the tangential direction relative to the outer peripheral surface of the developing sleeve 8 is 0 is made upstream of the position on the outer peripheral surface where the regulating blade 9 opposed to the developing sleeve 8 with respect to the rotational moving direction of the developing sleeve 8.

Figure 4:
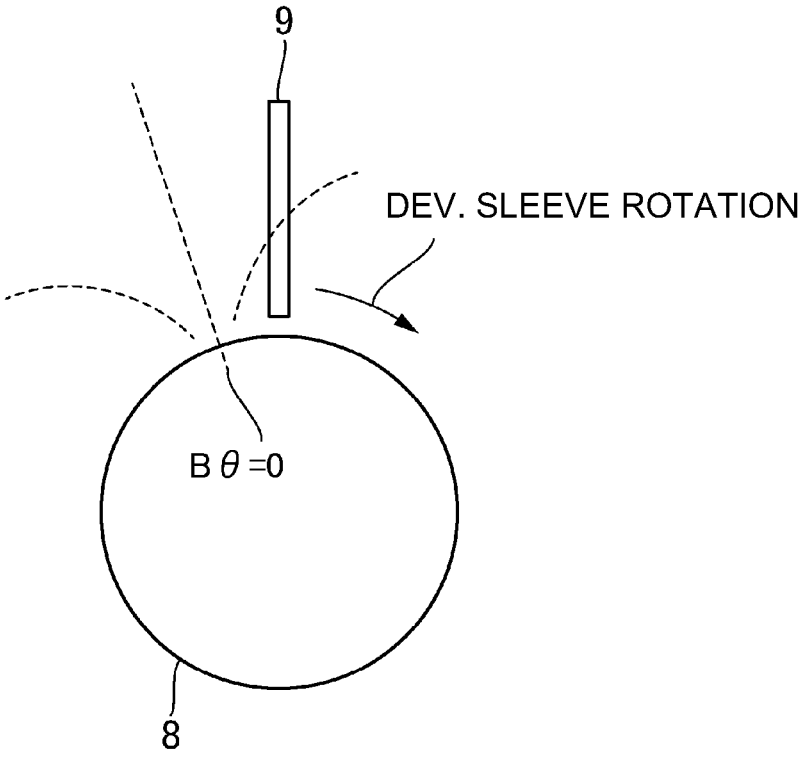
FIG. 4 is a schematic view showing directions of magnetic force lines adjacent to a magnetic pole opposing a regulating blade in the first embodiment, as viewed from a rear side of FIG. 1.

Here, in order to carry the carrier by the magnetic force in the blade opposing area, the N1 pole as the developer regulation pole is opposed to the regulating blade 9, and therefore, the sign of the value of the Br in the nationhood of the blade does not change. For this reason, the direction of the magnetic force line at the position adjacent to the blade where Bθ=0 can be discriminated. As shown in FIG. 4, if the position adjacent the blade where Bθ=0 is upstream of the position opposing to the regulating blade 9, the magnetic force line (broken line) is directed toward the downstream side. As a result of an investigation with various positions of the magnetic pole opposing to the regulating blade 9, when the position where Bθ=0 is upstream, the measured variation in the feeding amount is 1 mg/cm$^2$, whereas when it is downstream, the variation is 2 mg/cm$^2$.

When the magnetic flux density distribution provided by the developer regulation pole opposed to the regulating blade is substantially symmetrical, it would be considered to enlarge a half-peak width of the magnetic flux density distribution in an attempt to suppress the change in the magnetic flux density distribution at the blade opposing portion resulting from the tolerance of the magnet. Here, the half-peak width of the magnetic flux density provided by the regulation pole is a width of a range including the maximum magnetic flux density position where the magnetic flux density is one half of the maximum magnetic flux density. The tolerance of the magnet is related with the process capability of the magnet and the mounting accuracy of the magnet, as described hereinbefore. The process capability of the magnet includes the tolerance required during the manufacturing of the magnet, as described hereinbefore, and a magnet maker manufacturers the magnet within the tolerance. Thus, when the process capability tolerance is 2°, the magnet supplied by the magnet maker involves the variation within the range of 2°. The mounting accuracy involves the tolerance required when the magnet is mounted to the developing device and is 1°, for example, depending on the kind of devices though. In these examples, the tolerance after the magnet is mounted to the developing device is 3°, and therefore, the maximum magnetic flux density position (peak position) provided by the developer regulation pole may deviate within the range of 3°.

Therefore, when the attempt is made to avoid the problem arising from the tolerance using the half-peak width, it is required to enlarge the half-peak width so that the magnetic flux density distribution at the blade opposing position does not significantly change even if the peak magnetic flux density position deviates from the design position within the range of the tolerance. However, if the half-peak width of the magnetic pole opposing to the blade is enlarged, the design latitude of the other magnetic poles is decreased, as described hereinbefore. Particularly in this embodiment, in which the developing chamber and the stirring chamber are arranged vertically (vertical stirring type developing device), the surface level of the developer is high in the downstream side of the stirring chamber. Therefore, if the magnetic force is produced adjacent to the partition between the developing chamber and the stirring chamber, because of the less latitude in the design of the magnetic poles, a problem may arise. That is, the developer having a low toner content as a result of the consumption of the toner by the developing operation may not be collected into the stirring chamber and may go beyond the partition to a developer stagnation portion from which the developer is to be supplied onto the developing sleeve 8. Then, such a developer is supplied again onto the photosensitive drum 10 from the developing sleeve 8.

It is, therefore, preferable that no magnetic force is produced at the position opposing to the partition, but with the enlarged half-peak width described above, the magnetic force produced adjacent to the position opposing the partition tends to increase. Additionally, if a width of one magnetic pole is increased, it may be required to decrease the width or widths of another or other magnetic pole or poles. For these reasons, it is desirable to minimize the width of the magnetic pole.

[Developer Regulation Pole]

In this embodiment, the developer regulation pole (N1 the) disposed opposed to the regulating blade 9 is formed as follows. The position on the outer peripheral surface of the developing sleeve 8 at which the magnetic flux density in the normal line direction relative to the outer peripheral surface of the developing sleeve 8 is called the maximum value position (peak position). The position on the outer peripheral surface of the developing sleeve 8 corresponding to a center portion position of the half peak range of the magnetic flux density distribution of the developer regulation pole is called half peak center portion. The developer regulation pole is formed such that the maximum value position is deviated from the half peak center portion position by 3° in the circumferential direction of the developing sleeve 8. In addition, the developer regulation pole is formed such that such a position on the outer peripheral surface of the developing sleeve 8 as is opposed to the regulating blade 9 (blade opposing position) is disposed in such a side of the maximum value position as has the half peak center portion position.

In other words, as regards the magnetic flux density in the normal line direction relative to the outer peripheral surface of the developing sleeve 8, the maximum value position provided by the developer regulation pole opposed to the regulating blade 9 is deviated from the half peak center portion position such that the magnetic flux density distribution provided by the developer regulation pole is asymmetrical. In this embodiment, the tolerance of the magnet 8*a* is such that when the position of the magnetic pole is changeable by 3°, that is the tolerance is 3°. Therefore, the maximum value position of the developer regulation pole is deviated from the half peak center portion position by not less than 3°. By this arrangement, even when the position of the magnetic pole changes by 3°, the change of the magnetic flux density distribution at the position opposing the regulating blade 9 can be suppressed.

Figure 5:
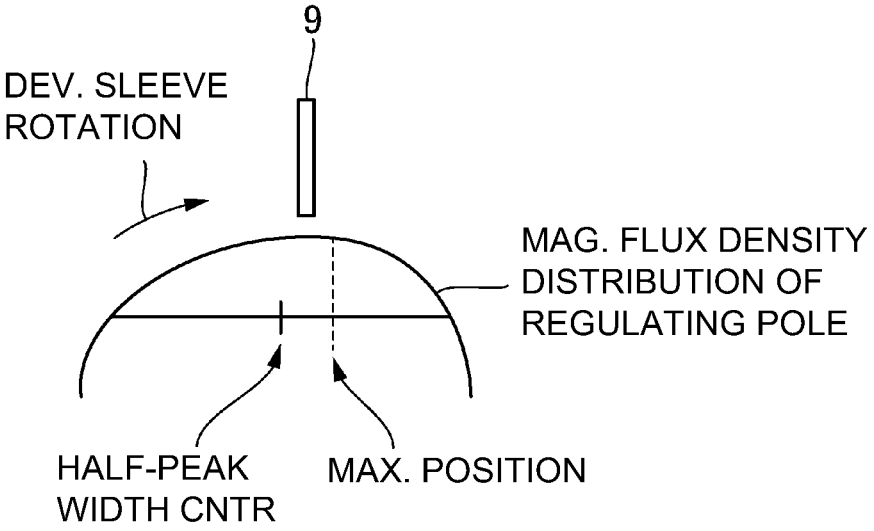
FIG. 5 is a schematic view showing a magnetic flux density distribution adjacent to the magnetic pole opposing the regulating blade in the first embodiment, as viewed from a rear side of FIG. 1.

In this embodiment, in addition to the asymmetrical shape of the magnetic flux density distribution provided by the developer regulation pole, the regulating blade 9 is opposed to a side in which the distribution of the magnetic flux density is gentle. By deviating the maximum value position of the developer regulation pole from the half peak center portion position, there is provided a portion in which the inclination of the magnetic flux density distribution is steep and a portion in which the inclination of the magnetic flux density distribution is gentle, as shown in FIG. 5. As will be understood from FIG. 5, the inclination of the magnetic flux density is gentle in the side of the maximum value position having the half peak center portion position, and is steep in the opposite side. In this embodiment, the regulating blade 9 is opposed to the range in which the inclination is gentle, so that even if the position of the magnetic pole is deviated due to the tolerance, the regulating blade 9 is still opposed to the range in which the inclination is gentle. Therefore, even if the position of the magnetic pole deviates, the change of the magnetic flux density is relatively small, and therefore, the change of the developer feeding amount can be suppressed.

Here, the half-peak width of the magnetic flux density of the developer regulation pole is not more than 70°, preferably not more than 60°, and further preferably not more than 50°. This is because if the half-peak width is larger than 70°, the width of the developer regulation pole is too large with the result of the influence to the design latitude of the other magnetic poles.

In order to assure that the regulating blade 9 is opposed to an area in which the inclination of the magnetic flux density distribution is gentle, the maximum value position of the developer regulation pole is deviated preferably by not less than 4° from the half peak center portion position, and further preferably by not less than 5°. When the tolerance is larger, that is, 4° or 5°, for example, the deviation of the maximum value position from the half peak center portion position is made larger, that is, not less than 8°, for example, preferably. However, the deviation of the maximum value position from the half peak center portion position is not more than 20°.

In addition, it is preferable that the developer regulation pole is formed such that the maximum value position is deviated from the blade position opposing to the regulating blade 9 on the outer peripheral surface of the developing sleeve 8 and from the half peak center portion position, toward the downstream with respect to the rotational moving direction of the developing sleeve 8. This is because the deterioration of the developer can be suppressed if the range in which the magnetic flux density distribution is gentle exists in the region upstream of the blade opposing position. More particularly, in the region upstream of the blade opposing position, the developer is not yet regulated by the regulating blade 9, and therefore, a large amount of the developer is carried on the developing sleeve 8. If the range in which the change of the magnetic flux density is steep exists upstream of the blade opposing position, the magnetic force applied to the developer carried on the developing sleeve 8 is relatively large. Then, the developer tends to be deteriorated by the high load applied to the developer. However, in order to stabilize the proper feeding of the developer under the regulating blade 9, it is preferable that the change of the magnetic flux density is gentle at the position opposing the regulating blade 9, and therefore, the maximum value position may be upstream of the blade opposing position.

In addition, in the case of the magnetic pole providing an asymmetrical magnetic flux density distribution as in this embodiment, the asymmetrical property is influenced by the magnetic poles adjacent thereto. However, when the adjacent magnetic pole is far and small, the change of the magnetic flux density is gentle, and when the adjacent pole is close and the magnetic force thereof is large, the change is steep. Therefore, in this embodiment, the magnetic pole providing a small magnetic force is disposed at a remote position in the upstream side of the developer regulation pole magnet, and in the downstream side, the magnetic pole providing a larger magnetic force is disposed at a closer position than the upstream magnetic pole. The positional relationships of the magnetic poles are set on the basis of the maximum magnetic flux density positions.

In this embodiment, as described hereinbefore, the maximum value position is deviated from the half peak center portion position by not less than 3°, and the position on the outer peripheral surface of the developing sleeve to which the regulating blade 9 is opposed is disposed in the side of the maximum value position in which the half peak center portion position exists. Therefore, the change of the magnetic flux density distribution in the neighborhood of the regulating blade 9 can be suppressed at low cost, while suppressing the influence to the design latitude of the other magnetic poles.

That is, by the deviation of the maximum value position from the half peak center portion position by not less than 3°, the magnetic flux density distribution of the developer regulation pole is asymmetrical. Therefore, the change of the distribution of the magnetic flux density of the developer regulation pole is gentle in the side in which the half peak center portion position exists than in the other side of the maximum value position. Because the regulating blade 9 is opposed to the side in which the change is gentle, the change of the magnetic flux density distribution in the neighborhood of the regulating blade 9 can be suppressed even if the positional relationship between the regulating blade 9 and the maximum value position of the developer regulation pole is deviated due to the tolerance or the like. As a result, even if the magnetic flux density distribution is deviated relative to the regulating blade 9 due to the tolerance, the change of the developer amount fed by the developing sleeve 8 can be suppressed. Therefore, image defects resulting from the change of the fed developer amount can be suppressed.

By the asymmetrical magnetic flux density distribution for the purpose of accommodating the tolerance or the like, the width of the developer regulation pole is suppressed, thus reducing the influence to the design latitude of the other magnetic poles. In addition, the maximum value position is deviated from the half peak center portion position by not less than 3°, and therefore, it is unnecessary to reduce the tolerance too much, and therefore, low cost arrangements are accomplished.

Embodiment 1

As described above, in this embodiment, the magnet 8*a* is disposed such that asymmetrical magnetic flux density distribution in which the magnetic flux density changes gently in the upstream side of the maximum value position of the magnetic flux density and changes steeply in the downstream side. And, the regulating blade 9 is disposed upstream of the maximum value position (Br peak position). By this, the magnetic flux density distribution changes gently in the upstream side of the regulating blade 9, so that the change of the magnetic flux density at the blade opposing position is reduced to suppress the change of the developer feeding performance due to the process capability or the mounting accuracy of the magnet, and the increase of the width of the magnetic pole is suppressed. In order to check such effects, experiments have been carried out under the following conditions.

The total tolerances of the process capability and the mounting accuracy of the developer regulation pole (blade opposing pole) of the magnet used in Embodiment 1 was 3°. Therefore, the maximum deviation of the blade opposing pole from the design reference position is 3° in the upstream or downstream sides. Therefore, in Embodiment 1, the maximum magnetic flux density position of the blade opposing pole is 8° downstream of the position of the center of the half peak range in the neighborhood of the outer peripheral surface of the developing sleeve 8. Additionally, the position where the regulating blade 9 is opposed to the developing sleeve 8 is 4° upstream of the maximum magnetic flux density position.

Figure 6:
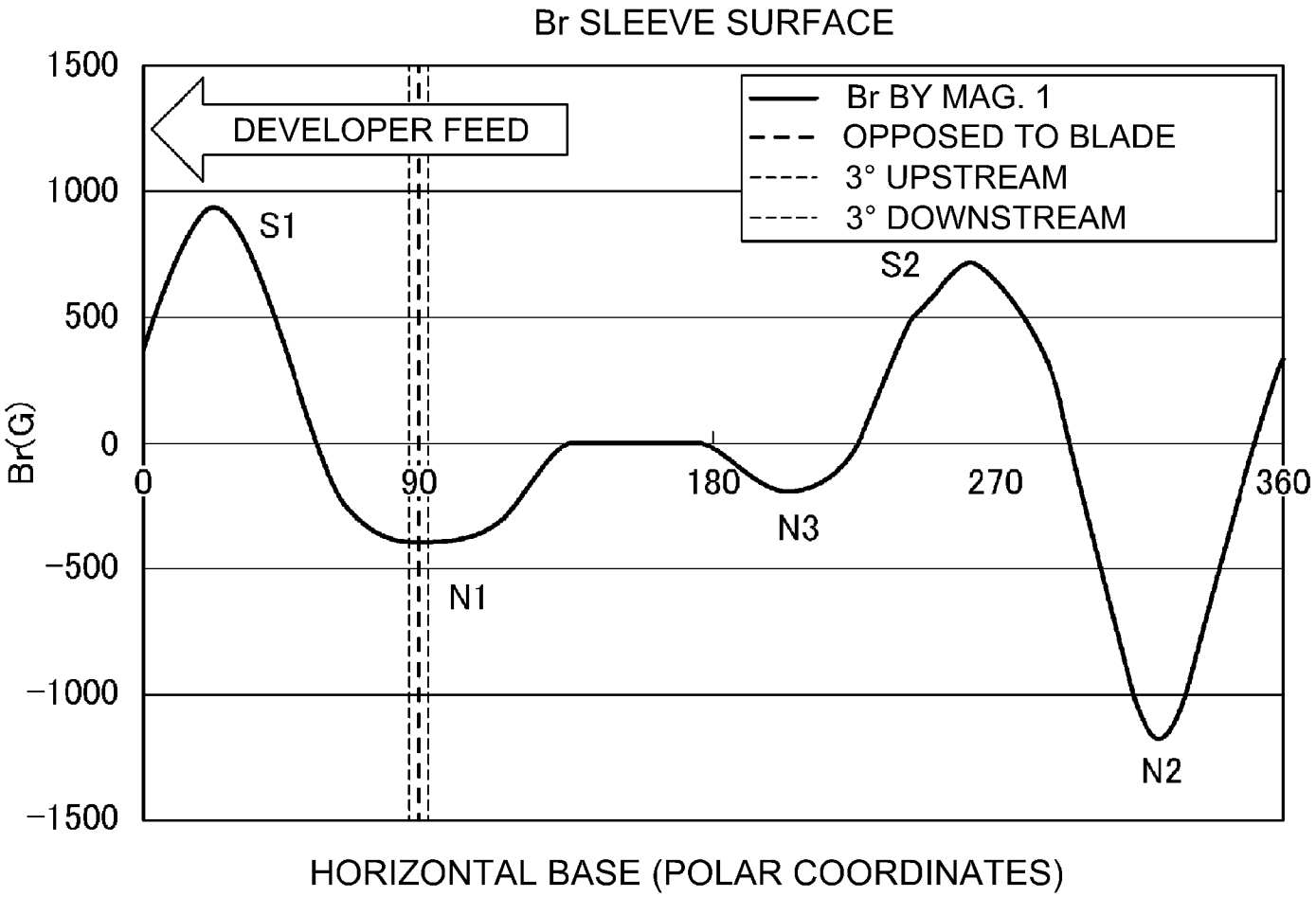
FIG. 6 shows a magnetic flux density distribution by a magnet in a normal line direction relative to an outer peripheral surface of a developing sleeve in Embodiment 1.

FIG. 6 shows a distribution of Br by the magnet 8*a* (mag. 1) on the outer peripheral surface (sleeve surface) of the developing sleeve 8 in Embodiment 1 of such a structure. A reference of the angle is the horizontal position (0°) of the drum, and the rotational moving direction is the opposite to the sleeve rotational moving direction. In FIG. 6, a vertical broken line indicates the position (blade opposing position) where the regulating blade 9 is opposed to the outer peripheral surface of the developing sleeve 8 and is the position of 86°. Broken lines in the opposite sides of the broken line show 3° range of the blade opposing position in the upstream and downstream sides. In addition, the maximum value of the magnetic flux density of the blade opposing pole (N1 pole) is 40 mT, and the half-peak width in the magnetic flux density distribution is 60°. In addition, the deviation between the maximum value position and the half peak center portion position is 8°. In Embodiment 1, the change of the feeding amount of the developer due to the tolerance of the magnet was 3 mg/cm^2.

Figure 7:
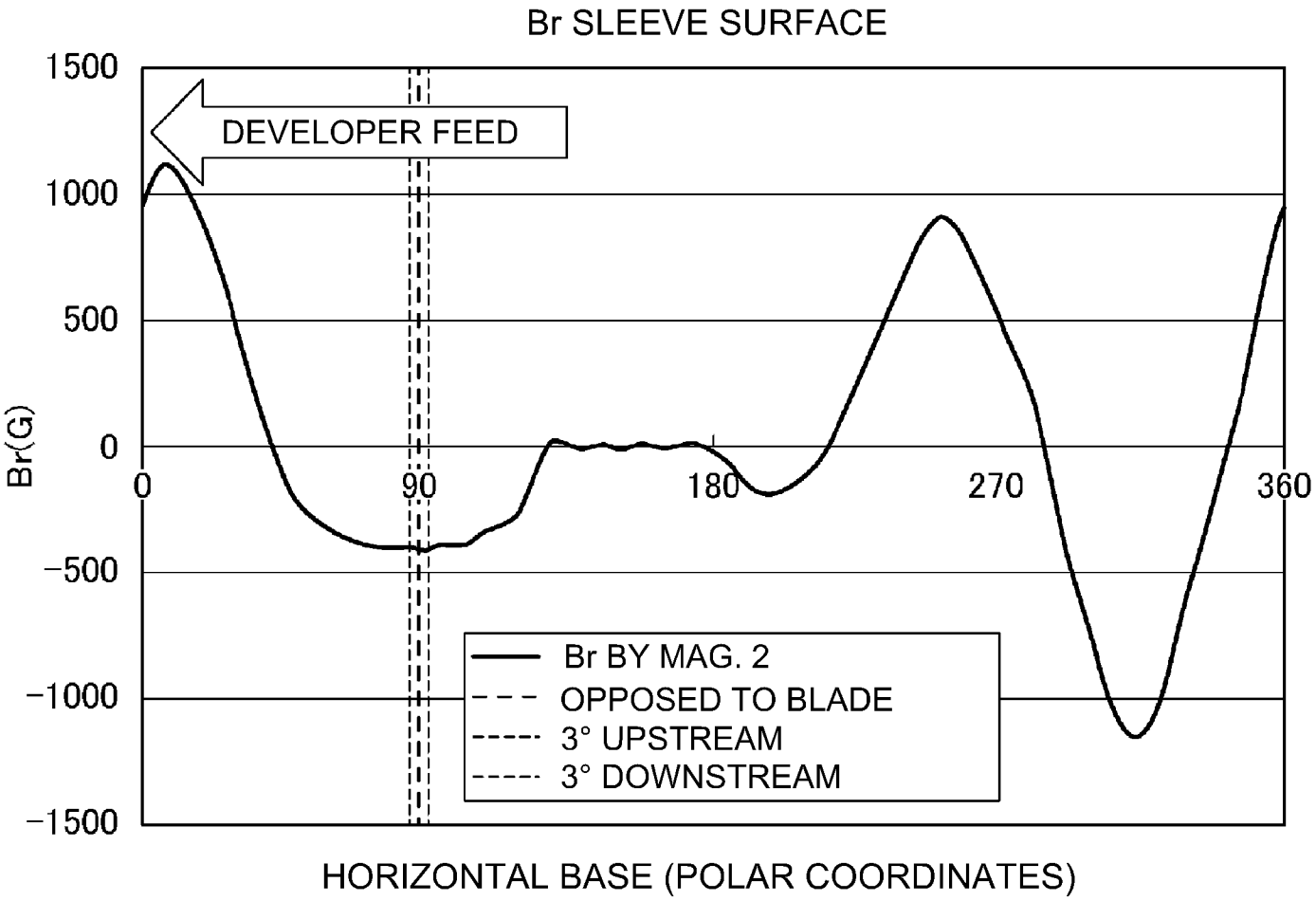
FIG. 7 shows a magnetic flux density distribution by a magnet in a normal line direction relative to an outer peripheral surface of a developing sleeve in comparison example 1.

On the other hand, a comparison example 1 has been prepared in which a symmetrical magnet (mag. 2) having the same maximum value position of the magnetic flux density distribution and the half peak center portion position. FIG. 7 shows the distribution of Br on the outer peripheral surface (sleeve surface) of the magnet of comparison example 1, similarly to FIG. 6. In comparison example 1, the blade opposing position where the regulating blade 9 is opposed to the developing sleeve 8 is 4° upstream of the maximum magnetic flux density position, similarly to Embodiment 1. In comparison example 1, the half-peak width of the magnetic flux density distribution is 76°, and the change of the feeding amount of the developer due to the tolerance of the magnet is made 3 mg/cm$^2$ which is the same as in Embodiment 1. The other conditions are the same as those in Embodiment 1. Table 1 shows a comparison between Embodiment 1 and comparison example 1.

TABLE 1

| | Change of Feeding property | Half-peak width | Relative position of Max. value position |
|---|---|---|---|
| Emb. 1 | 3 [mg/cm$^2$] | 60° | 8° downstream of Half-peak width center |
| Comp. Ex. 1 | 3 [mg/cm$^2$] | 76° | Half-peak width center |

As will be apparent from Table 1, according to Embodiment 1, the half-peak width can be reduced by 16°, while suppressing the change of the developer feeding amount attributable to the tolerances of the magnet at 3 mg/cm$^2$ which is equivalent to that of comparison example 1.

That is, in Embodiment 1, the maximum magnetic flux density position of the blade opposing pole is disposed 8° downstream of the half peak center portion position, and the blade opposing position is 4° upstream of the maximum magnetic flux density position. Therefore, even if the maximum value position of the blade opposing pole is deviated by 4° upstream or downstream, the change of the magnetic flux distribution in the neighborhood of the regulating blade 9 is gentle. As a result, even if the magnetic flux density distribution changes due to the tolerances, the change of the developer feeding amount can be suppressed. More particularly, the magnetic pole may deviate by 3° in the upstream or downstream direction due to the tolerances of the magnet, but the change of the developer feeding amount can be suppressed because the change of the magnetic flux distribution is gentle in the range of 3° in the upstream or downstream side of the blade opposing position (vertical broken lines). At this time, the half-peak width of the blade opposing pole in Embodiment 1 is 60°.

On the other hand, in comparison example 1, the half-peak width is required to be 76° in order to provide the same developer feeding amount change as in Embodiment 1. From the foregoing, in Embodiment 1, the half-peak width can be reduced by 16° as compared with comparison example 1 in which the magnetic flux density distribution of the blade opposing pole is symmetrical. That is, the width of the blade opposing pole can be narrowed, and the design latitude of the other magnets can be enhanced, while suppressing the developer feeding proper the adjacent to the regulating blade 9.

Second Embodiment

Referring to FIG. 8 through FIG. 12, a second embodiment of the present invention will be described. As is different from the developing device 1 of the first embodiment, the developing device 1A is provided with a guiding member 11 for guiding the developer in the developing container toward the developing sleeve 8. The other structures are the same as those of the first embodiment described above, and therefore, the same reference numerals as in Embodiment 1 are assigned to the elements having the similar structures in this embodiment, and the description will be made mainly about the portions different from the first embodiment.

In the developing device using a two component developer containing toner and carrier, the following problem may arise. In an upstream side of the regulating blade with respect to the rotational moving direction of the developing sleeve, a shear plane exists at the boundary portion between a portion (stationary layer) in which the flow of the developer is dammed by the regulating blade and a portion in which the developer is fed by the rotation of the developing sleeve. The developer is rubbed at the shear plane with the result that the toner particles separate from the carrier particles, and the separated toner particles may be fixed with each other to form a toner layer. If such a toner layer is produced, the amount of the developer supplied to the opposing portion where the developing sleeve is opposed to the photosensitive drum partially decreases due to the toner layer, and therefore, a sufficient amount of the toner for the development is not supplied, with the result of the decrease of the output image density.

In order to solve such a problem, Japanese Laid-open Patent Application 2013-231853 increases a total sum of the magnetic suction forces applied to the developer adjacent the regulating blade, while decreasing the total sum of the developer feeding forces along the developing sleeve. By doing so, the developer adjacent the regulating blade moves toward the center of the developing sleeve to suppress the production of the toner layer.

In this embodiment, similarly to the structure disclosed in Japanese Laid-open Patent Application 2013-231853, the feeding amount changes due to the magnet tolerance, while suppressing the improper feeding of the developer by the toner layer. More specific description will be made.

Figure 8:
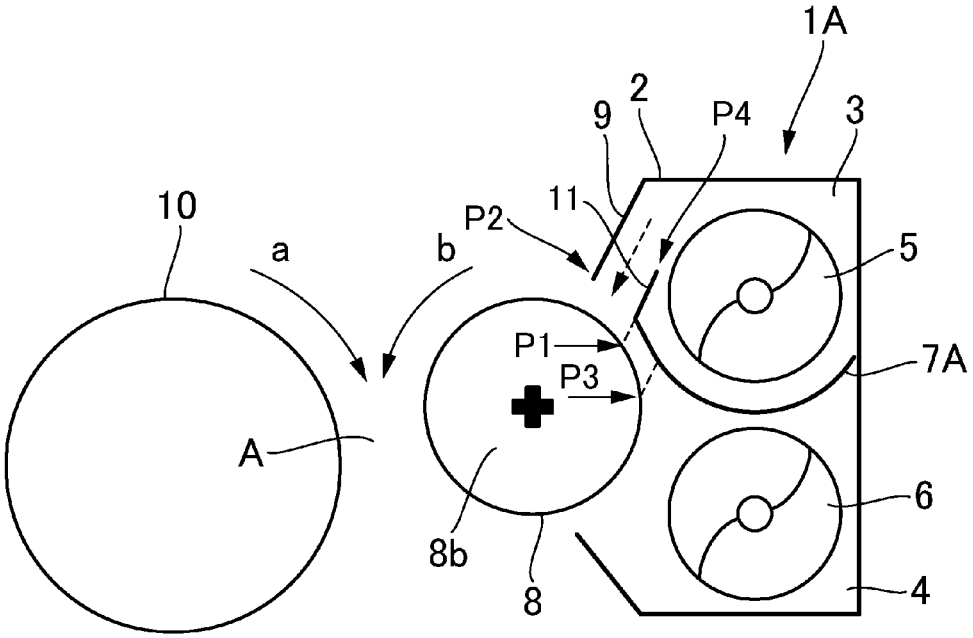
FIG. 8 is a schematic sectional view of a developing device according to a second embodiment of the present invention.

As shown in FIG. 8, a partition 7A between the developing chamber 3 and the stirring chamber 4 is extended to the neighborhood of the regulating blade 9, and there is provided a guiding member 11 for guiding the developer accommodated in the developing chamber 3 to the developing sleeve 8 from a vertically upper part. The guiding member 11 is provided opposed to the upstream side of the regulating blade 9 with respect to the rotational moving direction of the developing sleeve 8. The surface (guide surface) of the guiding member 11 opposed to the regulating blade 9 functions as a guiding function for properly supplying the developer through a gap between the regulating blade 9 and the guiding member 11 by the driving of the feeding screw 5.

Furthermore, the guiding member 11 is disposed opposed to the circumferential surface of the developing sleeve 8 so as to function as a regulating portion for regulating a developer supply starting position P1 from the developing chamber 3 to the developing sleeve 8. An angle of the guide surface of the guiding member 1 is normal to the surface of the developing sleeve 8. The closest distance between the guiding member 11 and the developing sleeve 8 is 1 mm. The supply starting position P1 of the guiding member 11 is set to be at a position 115° away from the horizontal position on the developing sleeve 8 and photosensitive drum 10 side in the direction opposite to the rotational moving direction of the developing sleeve 8. In this embodiment, a position P3 in the upstream side with respect to the rotational moving direction of the developing sleeve where the partition 7A is closest to the developing sleeve 8 is 180° away from the horizontal position in the direction opposite to the rotational moving direction of the developing sleeve 8.

Referring to FIG. 8, the flow of the developer in this embodiment will be described. The closest position P3 of the guiding member 11 toward the developing sleeve 8 is downstream of a repulsive force area provided by the same magnetic poles (N1 pole and N3 pole, FIG. 2), where the developer receives the force in the direction away from the developing sleeve 8 by the repulsive force, and is removed from the developing sleeve 8. Therefore, the developer does not pass through the gap between the developing sleeve 8 and the partition 7A. In other words, the developer is supplied to the regulating blade 9 over the guiding member 11 from the feeding screw 5, and the developer supplied over the guiding member 11 is stored between the regulating blade 9 and the guiding member 11.

In this embodiment, an apex position P4 of the guiding member 11 and a bottom point position P2 of the regulating blade 9 (closest position relative to the developing sleeve 8) are so selected that a line connecting those points are inclined relative to the horizontal direction at an angle of elevation of 30°. That is, the apex position P4 of the guiding member 11 is at a level higher than the closest position between the regulating blade 9 and the developing sleeve 8. This is done in order to store the amount of the developer sufficient to stably coat developing sleeve 8 with the developer, in the space between the regulating blade 9 and the guiding member 11. The length of the guiding member 11 is 11 mm. In this embodiment, the guiding member 11 is integral with the partition 7A and is made of the same material as the developing container 2.

In addition, a desirable range of the distance from the regulating blade 9 to a developer supply starting position P1 (distance along the circumference of the developing sleeve 8) is not less than 2 mm and not more than 8 mm. If the distance from the regulating blade 9 to the guiding member 11 is not more than 2 mm, the feeding path for the developer is too narrow with the result of the liability of the developer clogging. On the other hand, if the distance is too large, the contact distance between the developing sleeve 8 and the developer is so long that the time period of rubbing due to the magnetic force is long with the liability of the deterioration of the developer.

If the feeding screw 5 is substantially at the side of the regulating blade 9 as in this embodiment, the guiding member 11 includes the function of guiding the developer and the function of storing the developer. Additionally, the pressing of the developer when the feeding screw 5 is driven can be blocked. With the driving of the feeding screw 5, the developer is fed by being pressed in the axial direction of the screw, and at this time, the pressure is applied in the radial direction of the screw. By the side-by-side positional relationship between the regulating blade 9 and the feeding screw 5, the pressure in the radial direction results in a substantially vertical developer feeding force to the surface of the regulating blade 9, and therefore, this is not preferable from the standpoint of unevenness of the feeding performance. Therefore, in order to block the influence of the pressure by the feeding screw 5, it is preferable that the guiding member 11, particularly the apex position P4 (FIG. 8) is high. It is preferable that the apex position P4 of the guiding member 11 is positioned at a level higher than a line connecting the bottom point position P2 of the regulating blade and an axis of the feeding screw 5, at the least.

In this embodiment, the structure is such that Fr from the position of the guiding member 11 to the regulating blade 9 is always in the attracting direction, and Fr steeply and monotonically increases toward the regulating blade 9. A plurality of the magnetic poles of the magnet 8*b* in this embodiment is constructed such that an absolute value of the magnetic force Fr in the normal direction of the developing sleeve 8 monotonically increases from the trailing edge of the guiding member 11 toward the position of the regulating blade 9 with respect to the rotational moving direction of the developing sleeve 8. Here, the monotonical increase means that when the Fr is measured along the circumferential direction of the developing sleeve 8, the Fr monotonically increases in the circumferential range of the sleeve of not less than 2° and not more than 10°.

Additionally, the structure is such that the Fr in the upstream side of the guiding member 11 (upstream of the position P3) is substantially 0 or positive (repulsive force area). In the repulsive force area, the Fr may be negative if the absolute value is so small that the developer is spaced from the surface of the developing sleeve 8 by the centrifugal force by the rotation of the developing sleeve 8. In this embodiment, the repulsive force area ranges approx. 180° to 200°, and the Fr increases toward the downstream side from the repulsive force area in the rotational moving direction of the developing sleeve 8.

The Fr is a magnetic suction force toward the sleeve, and therefore, if the Fr is large, the developer having ridden over the guiding member 11 is strongly attracted to the developing sleeve 8. Therefore, the Fr between the guiding member 11 and the regulating blade 9 is made to monotonically increase toward the regulating blade 9. By doing so, the developer adjacent to the regulating blade 9 shown in FIG. 8 is attracted to the neighborhood of the developing sleeve 8 by the Fr Which is stronger at the force in the other positions between the regulating blade 9 and the guiding member 11. The Fr in the neighborhood of the regulating blade is preferably large in order to make the flow direction of the developer adjacent to the regulating blade 9 vertical (parallel to the regulating blade and substantially normal line to the outer peripheral surface of the developing sleeve 8). In this embodiment, the maximum value of the Fr between the guiding member 11 and the regulating blade 9 is at the position opposing the regulating blade 9. That is, the plurality of the magnetic poles of the magnet 8*b* are arranged so that in the range from the trailing edge of the guiding member 11 to the position of the regulating blade 9 with respect to the rotational moving direction of the developing sleeve, the position where the absolute value of the magnetic force Fr is the maximum is the position opposing the regulating blade 9.

On the other hand, in order to weaken the developer feeding force along the developing sleeve 8 with the rotation of the developing sleeve 8, thus to weaken the stagnation of the developer attributable to the collision to the regulating blade 9, a total sum of the Fr between the regulating blade 9 and the guiding member 11 is preferably small. Because the developer feeding by the rotation of the developing sleeve 8 is provided by the frictional force between the developer and the developing sleeve 8, and a normal reaction force=magnetic suction force Fr and the developer feeding force are proportional to each other. Therefore, in order to weaken the developer feeding force in the direction parallel with the developing sleeve 8 attributable to the production of the stationary layer by the collegian to the regulating blade 9, the total sum of the Fr between the regulation guide 9 and the guiding member 11 is preferably small.

The flow of the developer in the neighborhood of the regulating blade 9, is determined by the magnitude relation between the vertical force to the developer adjacent to the regulating blade and the lateral force (perpendicular to the regulating blade, substantially parallel with the tangent line direction of the outer peripheral surface of the developing sleeve 8). Therefore, in order to make the flow of the developer vertical adjacent to the regulating blade, it is necessary and sufficient conditions that the vertical force is strengthened by strengthening the Fr adjacent to the regulating blade and that the total sum of the Fr between the regulating blade and the feeding guide is weakened thus weakening the lateral force. In order to satisfy both of them, the distribution of Fr between the regulating blade 9 and the guiding member 11 is such that Fr is large only at the position adjacent to the regulating blade. In other words, it can be said to be qualitatively desirable that the distribution of the Fr between the regulating blade 9 and the guiding member 11 steeply and monotonically increases toward the regulating blade 9.

Here, an integration of the Fr from the regulating blade 9 to the position 2 mm upstream of the regulating blade 9 with respect to the rotational moving direction of the developing sleeve 8 is FrNear. An integration of the Fr from the trailing edge of the guiding member 11 to the regulating blade 9 is FrAll. At this time, as disclosed in Japanese Laid-open Patent Application 2013-231853, the production of coating defect is prevented quantatively if the ratio of the FrNear to the integration value FrAll is not less than 60%. Therefore, in this embodiment, the magnetic poles of the magnet 8*b* are provided such that the ratio of the FrNear to the FrAll is not more than 60%.

In the range from the regulating blade to the 2 mm upstream thereof, the developer is compressed and therefore the stationary layer tends to be produced, and therefore, it is significant that the flow of the developer adjacent to the range is directed perpendicularly to the sleeve.

Here, in order to increase the ratio of the FrNear to the FrAll, the Fr adjacent to the regulating blade 9 is required to be larger than the force in the other range between the guiding member 11. In order to satisfy this requirement, as will be understood from equation (1), it is required to increase the change of the magnetic distribution adjacent to the regulating blade 9. If an attempt is made to increase the ratio of the FrNear to the FrAll using a magnet having the developer regulation pole (blade opposing pole opposing the regulating blade 9 which provides a substantially symmetrical magnetic flux density distribution) the result is narrowing of the half-peak width. If the half-peak width is narrowed, the change of the magnetic flux density distribution adjacent to the regulating blade increases with the result of a large change of the developer feeding amount due to the tolerances of the magnet.

In view of the above, according to this embodiment, the magnetic flux density distribution provided by the developer regulation pole of the magnet 8*b* is asymmetrical, similarly to the first embodiment. That is, in this embodiment, the magnetic flux density distribution by the developer regulation pole changes gently in the upstream side of the maximum value position with respect to the rotational moving direction of the developing sleeve 8 and changes steeply in the downstream side thereof. Additionally, the regulating blade 9 is disposed at the position upstream of the maximum value position with respect to the rotational moving direction of the developing sleeve. As described hereinbefore, the maximum value position is the position on the outer peripheral surface of the developing sleeve 8 where the magnetic flux density (Br) in the normal direction relative to the outer peripheral surface of the developing sleeve 8 is the maximum. The blade opposing position is the position on the outer peripheral surface of the developing sleeve 8 where the regulating blade 9 opposes the sleeve, and the half peak center portion position is the position on the outer peripheral surface of the developing sleeve 8 corresponding to the central position of the range between the half peak positions of the magnetic flux density distribution.

In this manner, by steeply decreasing the peak of the Br in the downstream side of the regulating blade 9, the Fr adjacent to the regulating blade can be deeply increased. And, the ratio of the FrNear to the FrAll is increased, and the change of the magnetic flux density distribution in the upstream side of the regulating blade 9 is made small, by which the change of the feeding performance attributable to the process capability and/or the mounting accuracy of the magnet can be suppressed.

Embodiment 2

To check the effects of the embodiment, the following experiments have been carried out. The total of the tolerances of the process capability and the mounting accuracy of the developer regulation pole (blade opposing pole) of the magnet used in Embodiment 2 is 3°. Therefore, the maximum deviation of the blade opposing pole from the design reference position is 3° in the upstream or downstream sides. Therefore, in Embodiment 2, the maximum magnetic flux density position of the blade opposing pole is 20° downstream of the position of the center of the half peak range in the neighborhood of the outer peripheral surface of the developing sleeve 8. Additionally, the position where the regulating blade 9 is opposed to the developing sleeve 8 is 3° upstream of the maximum magnetic flux density position.

Figure 9:
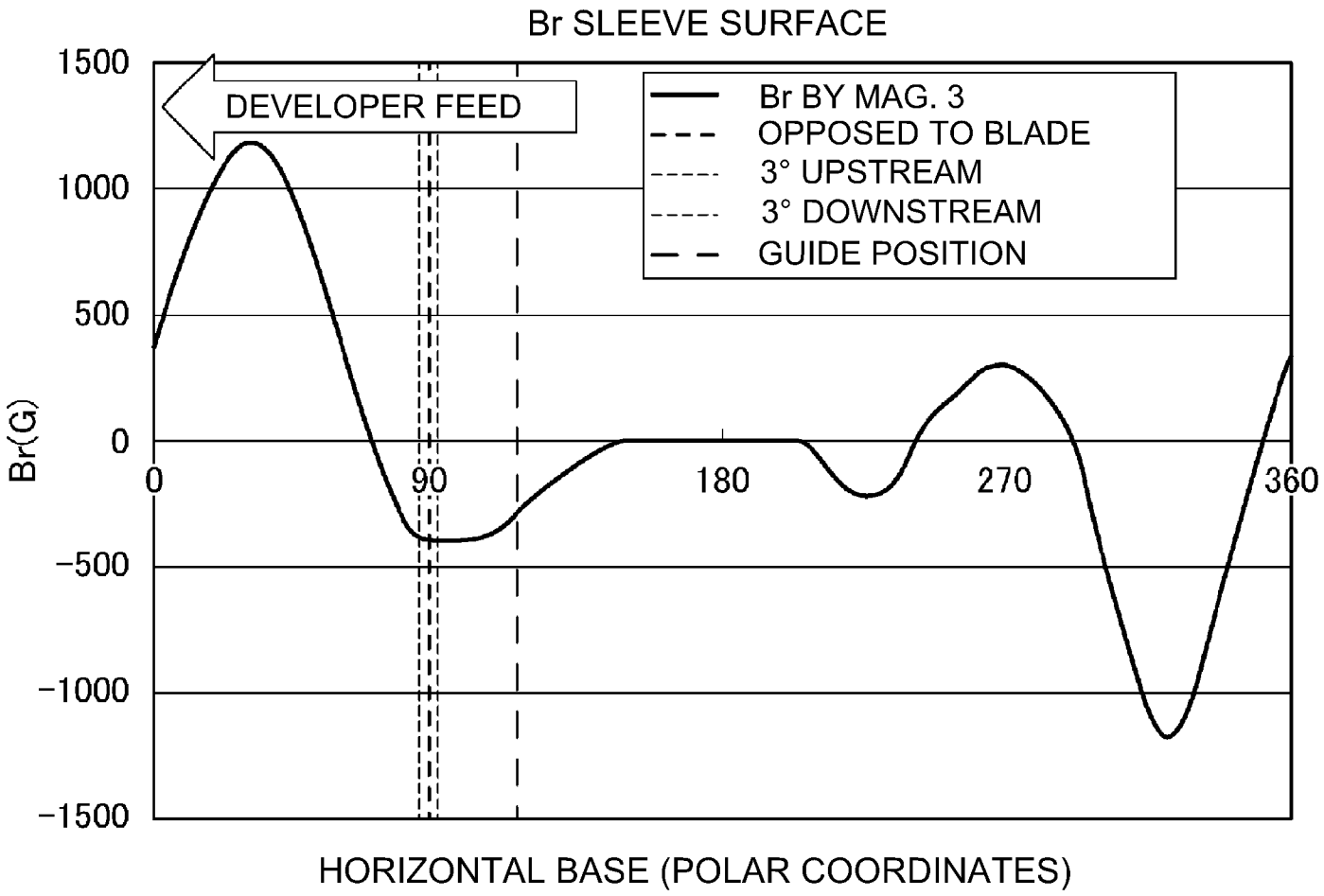
FIG. 9 shows a magnetic flux density distribution by a magnet in a normal line direction relative to an outer peripheral surface of a developing sleeve in Embodiment 2.

FIG. 9 shows a distribution of Br by the magnet 8*a* (mag. 3) on the outer peripheral surface (sleeve surface) of the developing sleeve 8 in Embodiment 2 of such a structure. A reference of the angle is the horizontal position(0°) of the drum, and the rotational moving direction is the opposite to the sleeve rotational moving direction. In FIG. 9, a vertical broken line indicates the position (blade opposing position) where the regulating blade 9 is opposed to the outer peripheral surface of the developing sleeve 8 and is the position of 86°. Broken lines in the opposite sides of the broken line show 3° range of the blade opposing position in the upstream and downstream sides. In addition, a length broken line indicates the position where the guiding member 11 is opposed to the outer peripheral surface of the developing sleeve 8. The maximum value of the magnetic flux density of the blade opposing pole (developer regulation pole) is 40mT, and the half-peak width of the magnetic flux density distribution is 45°. In addition, the deviation between the maximum value position and the half peak center portion position is 20°. In Embodiment 2, the change of the feeding amount of the developer due to the tolerance of the magnet was 3 mg/cm$^2$.

Figure 10:
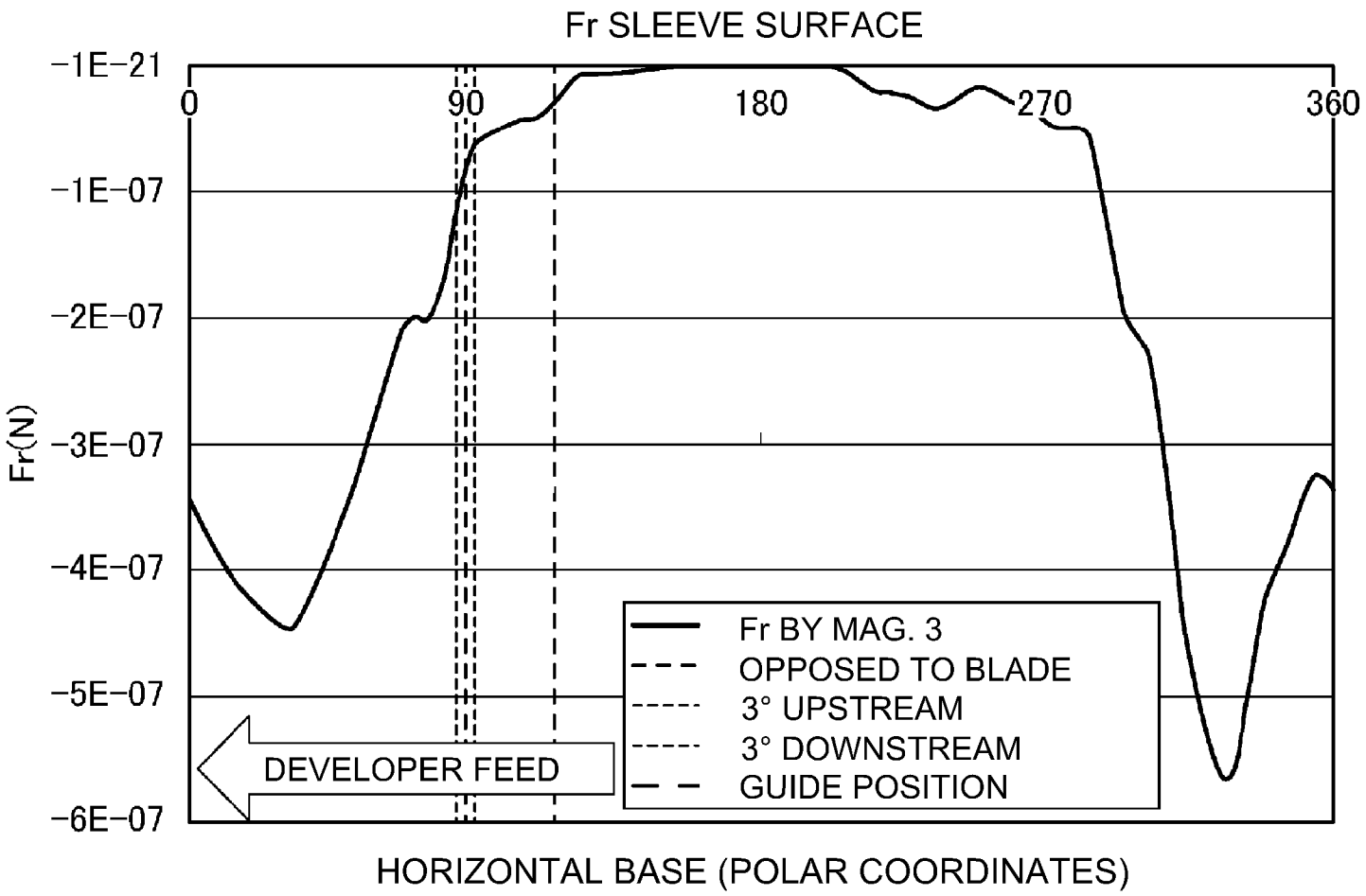
FIG. 10 shows a magnetic flux density distribution by the magnet in the normal line direction relative to the outer peripheral surface of the developing sleeve in Embodiment 2.

In addition, by using the magnet 8*b* (mag. 3) in Embodiment 2, the ratio of the FrNear to the FrAll is increased to more steeply change the magnetic flux density distribution in the downstream side of the regulating blade. FIG. 10 shows the distribution of the magnetic force (Fr) in the direction toward the sleeve center applied to the carrier on the surface of the sleeve. In Embodiment 2, the Fr adjacent to the regulating blade is relatively large, and the ratio of the FrNear to the FrAll is 65%.

On the other hand, as comparison example 2, the use is made to mag. 1 of Embodiment 1 by which the magnetic flux density distribution provided by the developer regulation pole is asymmetrical, and as comparison example 3, the use is made to mag. 2 of comparison example 1 by which the magnetic flux density distribution is symmetrical. These mags. 2 and 3 are incorporated in the developing device shown in FIG. 8. At this time, the change of the developer feeding amount attributable to the tolerances of the magnet was 3 mg/cm♂2♂, similarly to Embodiment 2.

Figure 11:
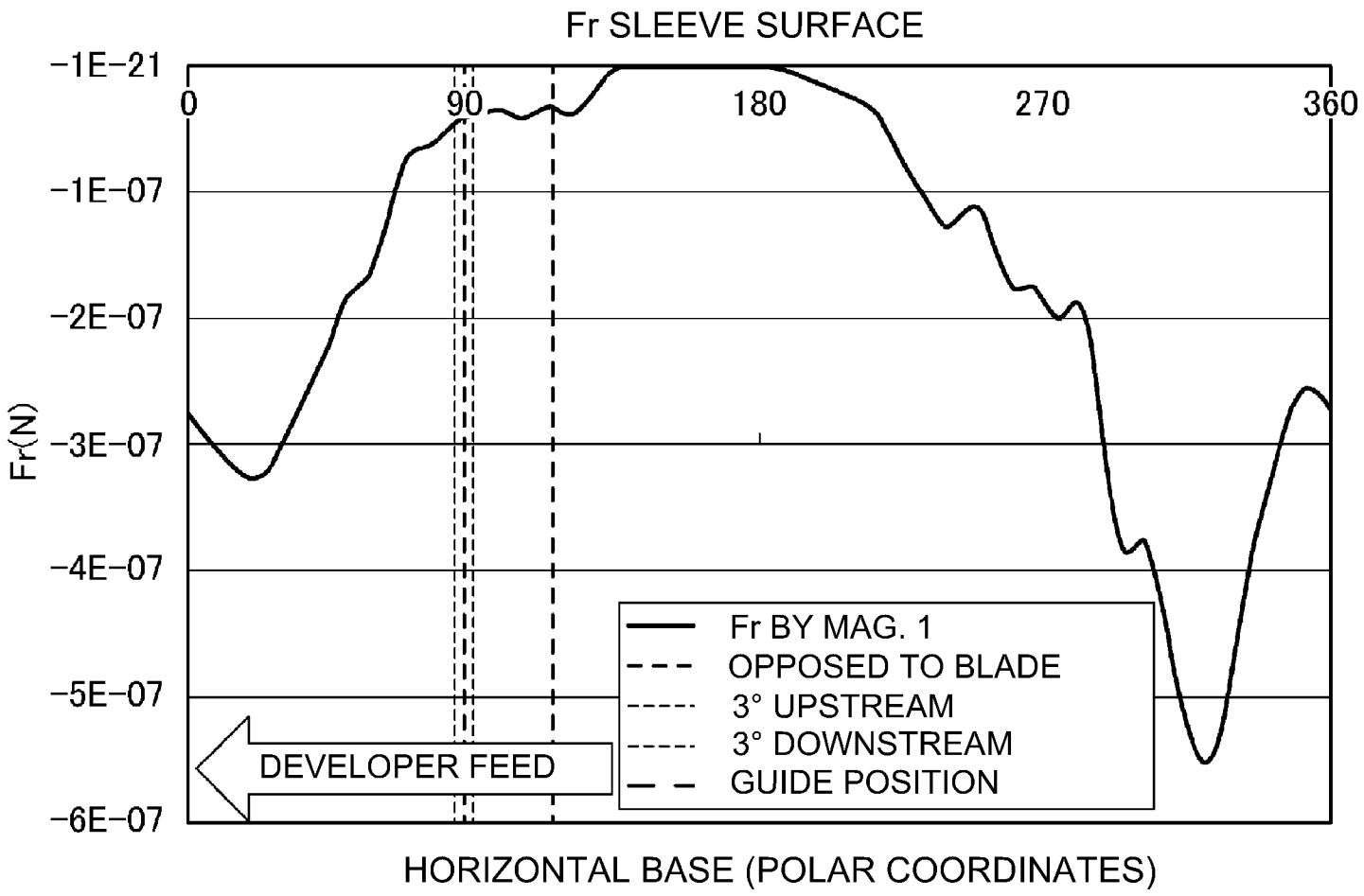
FIG. 11 shows a magnetic flux density distribution by a magnet in a normal line direction relative to an outer peripheral surface of a developing sleeve in comparison example 2.
Figure 12:
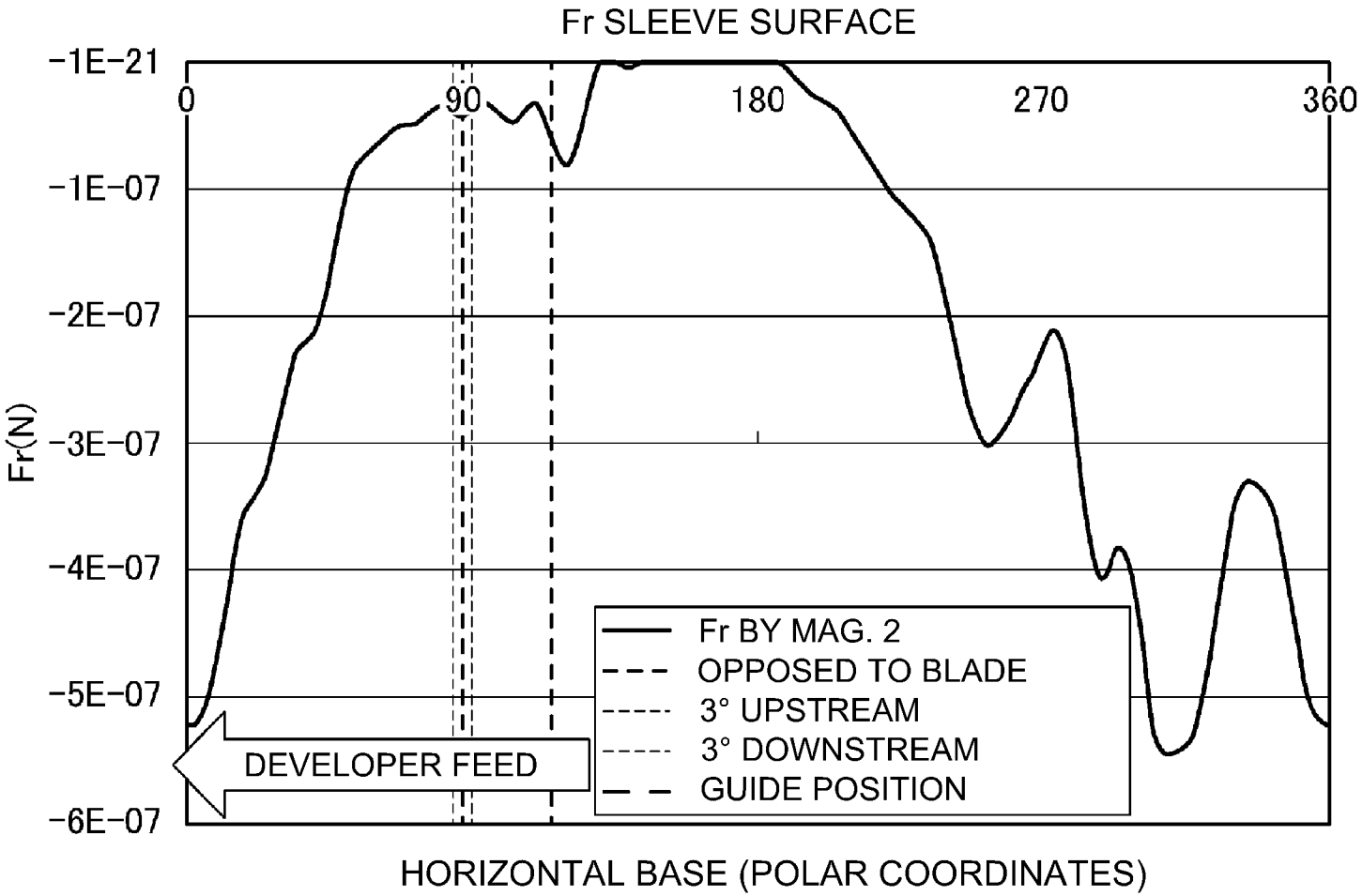
FIG. 12 shows a magnetic flux density distribution by a magnet in a normal line direction relative to an outer peripheral surface of a developing sleeve in comparison example comparison example 3.

FIG. 11 and FIG. 12 show the magnetic force (Fr) distribution toward the sleeve center applied to the carrier on the surface of the sleeve, using mags. 1 and 2, respectively. In comparison example 2, the ratio of the FrNear to the FrAll is 55%, and in comparison example 3, the ratio of the FrNear to the FrAll is 50%. The other conditions are the same as those in Embodiment 2. Table 2 shows a comparison between Embodiment 2 and comparison examples 2 and 3.

TABLE 2

| | Change of Feeding property | Half-peak width | Relative position of Max. value position | FrNear/ FrAll | Improper feeding |
|---|---|---|---|---|---|
| Comp. Ex. 2 | 3 [mg/cm$^2$] | 60° | 8° downstream of Half-peak width center | 55% | Occurred |
| Comp. Ex. 3 | 3 [mg/cm$^2$] | 76° | Half-peak width center | 50% | Occurred |
| Emb. 2 | 3 [mg/cm$^2$] | 45° | 20° downstream of Half-peak width center | 65% | Not occurred |

As will be understood from Table 2, according to Embodiment 2, the change of the developer feeding amount attributable to the tolerances of the magnet is 3 mg/cm$^2$ which is equivalent to comparison examples 2, 3, and the half-peak width can be reduced as compared with comparison examples 2, 3. That is, according to Embodiment 2, the magnetic flux density maximum value position of the blade opposing pole is 20° downstream of the half peak center portion position, and the blade opposing position is 3° upstream of the magnetic flux density maximum value position. Therefore, even if the maximum of the blade opposing pole is shifted upstream by 3°, the change of the magnetic flux distribution adjacent to the regulating blade is gentle. As a result, even if the magnetic flux density distribution changes due to the tolerances, the change of the developer feeding amount can be suppressed. In Embodiment 2, the ratio of the FrNear to the FrAll is 65%, and therefore, the formation of the toner layer in the upstream side of the regulating blade is suppressed, and the developer improper feeding does not occur. That is, because the magnetic flux density distribution steeply changes in the downstream side of the regulating blade, and therefore, the magnetic force adjacent to the regulating blade is large as compared with the other range, as a result, the FrNear/FrAll can be made large. For these reasons, the developer improper feeding can be avoided.

On the other hand, in comparison examples 2, 3, the FrNear/FrAll is small (less than 60%), and therefore, the toner layer formation cannot be efficiently suppressed, and the developer improper feeding arises when a durability test operation is carried out or when low print ratio images are continuously formed. From the foregoing, according to Embodiment 2 of the present invention, the half-peak width can be reduced, and therefore, the width of the blade opposing pole can be reduced while stabilizing the developer feeding performance adjacent to the regulating blade 9, and therefore, the design latitude of the other magnetic poles can be enhanced. In addition, because of the FrNear/FrAll is 65%, the developer improper feeding can be avoided. With the structure of comparison example 2, however, the magnetic flux density distribution by the developer regulation pole is asymmetrical, and therefore the effect of the present invention can be provided. In this embodiment, the production of the stationary layer can be suppressed by a simple structure, by the structure of Embodiment 1 plus the FrNear/FrAll not less than 60%. As regards the stationary layer, it can be suppressed by carrying out an operation such as an operation of discharging the developer from the developing device onto the photosensitive drum at predetermined timing during the period of non-image-formation.

Other Embodiments

As shown in FIG. 1, in the foregoing embodiments, the image forming apparatus includes photosensitive drums 10Y, 10M, 10C, 10K from which the images are directly transferred onto the recording material P fed by the recording material feeding belt 24. However, the present invention is applicable to the other structures. For example, the present invention is applicable to the structure which uses an intermediary transfer member such as an intermediary transfer belt in place of the recording material feeding belt 24. That is, the present invention is applicable to an image forming apparatus in which after the toner images of the respective colors are transferred from the photosensitive drums 10Y, 10M, 10C, 10K onto the intermediary transfer member, and thereafter, the combined toner images are transferred onto the recording material P all together (secondary-transfer). In addition, the present invention is not limited to a particular charging type, transfer type, cleaning type or fixing type.

In the foregoing embodiments, the present invention has been applied to a vertical stirring type developing device in which the developing chamber is provided in the upper position of the developing container, and the stirring chamber is disposed in the lower position thereof. However, in the present invention, the magnet is disposed in the developing sleeve to carry and feed the developer, what, the present invention is applicable to the structures if the layer thickness of the developer is regulated by a regulating blade. For example, the present invention is applicable to the structure in which the developing chamber and the stirring chamber are arranged horizontally. The present invention is applicable to structures other than the structure including a developing chamber for supplying the developer to the developing sleeve and a separate stirring chamber for collecting the developer from the developing sleeve. For example, the present invention is applicable to the structure in which the supply and collection of the developer between the developing chamber and the developing sleeve are carried out, and the developer is a graded between the stirring chamber and the developing chamber.

INDUSTRIAL APPLICABILITY

A developing device with which the influence to the design latitude of the magnetic poles is suppressed, and the change of the magnetic flux density distribution adjacent to a regulating member can be suppressed at a low cost can be provided.

REFERENCE NUMERALS

1, 1A . . . developing device:
2 . . . developing container:
8 . . . developing sleeve:
8*a*, 8*b* . . . magnet:
9 . . . regulating blade (developer regulating member):
11 . . . guiding member.

The invention claimed is:

1. A developing apparatus comprising:

a developing container configured to contain a developer containing toner and carrier;

a rotatable developing member configured to carry the developer;

a magnet provided non-rotatably and stationarily inside the rotatable developing member and provided with a regulating pole; and a regulating portion configured to regulate an amount of the developer carried on the rotatable developing member by a magnetic force of the regulating pole;

wherein in a state in which the amount of the developer carried on the rotatable developing member is regulated by the regulating portion, the rotatable developing member feeds the developer to a developing position, wherein with respect to a rotational direction of the rotatable developing member, a half-peak center position, which is a central position of a half-peak width of a magnetic flux density of the regulating pole in a normal direction relative to an outer peripheral surface of the rotatable developing member is not less than 3° upstream of a maximum position where the magnetic flux density of the regulating pole in the normal direction relative to the outer peripheral surface of the rotatable developing member is maximum, and wherein with respect to the rotational direction of the rotatable developing member, an opposing position where the regulating portion is opposed to the outer peripheral surface of the rotatable developing member is downstream of a position where the magnetic flux density of the regulating pole in a tangential direction relative to the outer peripheral surface of the rotatable developing member is zero.

2. A developing apparatus according to claim 1, wherein with respect to the rotational direction of the rotatable developing member, the half-peak center position is not less than 4° upstream of the maximum position.

3. A developing apparatus according to claim 1, wherein with respect to the rotational direction of the rotatable developing member, the half-peak center position is not less than 5° upstream of the maximum position.

4. A developing apparatus according to claim 1, wherein with respect to the rotational direction of the rotatable developing member, the half-peak center position is not less than 3° and not more than 20° upstream of the maximum position.

5. A developing apparatus according to claim 1, wherein with respect to the rotational direction of the rotatable developing member, the half-peak center position is not less than 4° and not more than 20° upstream of the maximum position.

6. A developing apparatus according to claim 1, wherein with respect to the rotational direction of the rotatable developing member, the half-peak center position is not less than 5° and not more than 20° upstream of the maximum position.

7. A developing apparatus according to claim 1, wherein the half-peak width is not more than 70°.

8. A developing apparatus according to claim 1, wherein the half-peak width is not more than 60°.

9. A developing apparatus according to claim 1, wherein the half-peak width is not more than 50°.

10. A developing apparatus according to claim 1, wherein the magnet further includes a magnetic pole provided upstream of the regulating pole and adjacent the regulating pole, with respect to the rotational direction of the rotatable developing member, and having the same magnetic polarity as that of the regulating pole.

11. A developing apparatus according to claim 1, wherein the magnet includes a plurality of magnetic poles including the regulating pole, and wherein the number of the plurality of magnetic poles is five.

* * * * *